US010788188B2

(12) United States Patent
Gladden et al.

(10) Patent No.: US 10,788,188 B2
(45) Date of Patent: Sep. 29, 2020

(54) CONFIGURABLE LUMINAIRES AND COMPONENTS

(71) Applicant: Glint Photonics, Inc., Burlingame, CA (US)

(72) Inventors: Christopher Gladden, Burlingame, CA (US); Andrew Kim, Burlingame, CA (US); Peter Kozodoy, Burlingame, CA (US); John Lloyd, Burlingame, CA (US)

(73) Assignee: Glint Photonics, Inc., Burlingame, CA (US)

( * ) Notice: Subject to any disclaimer, the term of this patent is extended or adjusted under 35 U.S.C. 154(b) by 0 days.

(21) Appl. No.: 16/199,382

(22) Filed: Nov. 26, 2018

(65) Prior Publication Data

US 2019/0376663 A1 Dec. 12, 2019

Related U.S. Application Data

(60) Provisional application No. 62/590,649, filed on Nov. 27, 2017, provisional application No. 62/590,650, (Continued)

(51) Int. Cl.
*F21V 5/00* (2018.01)
*F21S 41/30* (2018.01)
(Continued)

(52) U.S. Cl.
CPC ..... *F21V 5/008* (2013.01); *F21S 41/141* (2018.01); *F21S 41/20* (2018.01); *F21S 41/30* (2018.01); *F21V 13/04* (2013.01)

(58) Field of Classification Search
None
See application file for complete search history.

(56) References Cited

U.S. PATENT DOCUMENTS 5,971,756 A * 10/1999 Fjelstad ..... A61C 19/05 433/68
8,227,828 B2 7/2012 Li et al.
(Continued)

OTHER PUBLICATIONS

International Search Report and Written Opinion dated Feb. 14, 2019; PCT/2018/062413.

*Primary Examiner* — Ashok Patel
(74) *Attorney, Agent, or Firm* — David J. Thibodeau, Jr.; VLP Law Group LLP

(57) ABSTRACT

A steerable illumination fixtures include an emitting source and a refractive optical system that steers an emitted beam by relative translation of the emitting source against the optical system. The light emitting source may be placed along an optical axis of one or more lenses to produce an output beam along that axis, or translated in-plane (orthogonal to the optical axis) relative to the lenses to produce a steered beam. The optical system may include refractive lenses and in some embodiments mixing channels and/or one or more baffles with apertures. The design is typically optimized to produce a round, uniform beam that retains approximately the same power level and beam width as it is steered. It is beneficial, but not required, that a second lens have a diameter equal to or larger than a first lens. The lenses may be configured so that the effective focal plane of the two lenses together is located approximately at the plane of the light emitting source.

16 Claims, 41 Drawing Sheets

Related U.S. Application Data filed on Nov. 27, 2017, provisional application No. 62/653,754, filed on Apr. 6, 2018.

(51) Int. Cl.

| | |
|---|---|
| ***F21S 41/20*** | (2018.01) |
| ***F21V 13/04*** | (2006.01) |
| ***F21S 41/141*** | (2018.01) |

(56) References Cited

U.S. PATENT DOCUMENTS

| | | | | |
|---|---|---|---|---|
| 8,523,403 | B2 | 9/2013 | Pujol et al. | |
| 8,979,044 | B2 | 3/2015 | Seidl et al. | |
| 2011/0280018 | A1 | 11/2011 | Vissenberg et al. | |
| 2013/0101953 | A1* | 4/2013 | Stone | F21V 5/002 433/29 |
| 2015/0211708 | A1* | 7/2015 | Stavely | F21V 5/007 348/164 |
| 2018/0245776 | A1* | 8/2018 | Gladden | F21V 29/503 |

* cited by examiner

CONFIGURABLE LUMINAIRES AND COMPONENTS

CROSS-REFERENCE TO RELATED APPLICATIONS

This patent application claims priority to the following U.S. Provisional Patent Applications, each of which are incorporated herein by reference in their entirety: Ser. No. 62/590,649, filed Nov. 27, 2017, by Andrew Kim et al.; Ser. No. 62/590,650, filed Nov. 27, 2017, by Andrew Kim et al.; and Ser. No. 62/653,754, filed Apr. 6, 2018, by John Lloyd.

TECHNICAL FIELD

This patent application relates to optics, and more specifically to optical systems for controlling beam properties in illumination.

BACKGROUND

1. LED Light Source Uniformity and Angular Distribution

Light-emitting diodes (LEDs) are broadly used in lighting systems as an energy-efficient, long-lived light source. FIG. 1 shows the design of a typical phosphor-converted LED 109. It is composed of an LED die 111 and a phosphor coating 112. The phosphor coating 112 down-converts some of the short-wavelength light emitted by the LED die, absorbing it and re-emitting as longer-wavelength light. Such phosphor-coated LEDs routinely have color non-uniformity, both spatially across the LED and angularly around the LED, that is undesirable for high-quality lighting applications. LEDs also have irregular light intensity variations that are further undesirable, often taking the form of sharp rings or halos of light at the periphery of the light beam. Other conventional light sources may have non-uniformity that is also undesirable.

Color non-uniformity of some degree is fundamental to phosphor-coated LEDs, due to variation in the mean path length of light emitted by the LED die 111 through the phosphor coating 112 as it varies versus light emission angle or as it varies across the surface of the LED die or both. This is shown in FIG. 1, where light rays 115 are emitted from different areas of the LED die 111, and traverse different lengths of phosphor coating 112. In many LEDs, the greatest color non-uniformity and intensity irregularity is present at low angles of light emission (angles far from perpendicular to the emitting surface of the LED) or is localized to near the edges of the LED die 111, or both. This uniformity challenge is fundamental and is well-recognized by the lighting industry. Various means have been employed or discussed to reduce the color variation of LEDs, including processes to make phosphor coatings more uniform, mixing scattering materials into the phosphor, and adding dichroic layers.

Other types of light emitters may also suffer from variations in color uniformity both spatially within the emitter and in their angular output.

Various means for collimating the broad light output of LEDs or mixing the intensity and color of arrays of LEDs have been taught, including long reflector cups. See for example, U.S. Pat. No. 4,964,025 to Smith, U.S. Pat. No. 6,200,002 to Marshall, U.S. Pat. No. 6,547,416 to Pashley, U.S. Pat. No. 8,529,103 to Tukker), long lightpipes (U.S. Pat. No. 9,411,083 to Angelini), and large rectangular chambers or planar guides (U.S. Pat. No. 5,921,652 to Parker, and U.S. Pat. No. 6,536,914 to Hoelen). These means of collimating and mixing light all feature geometries that are many times longer than the width of the light source, in order to achieve extensive mixing of light and good control over the angular distribution of light output.

U.S. Pat. No. 8,247,827 to Helbing also suggested that phosphor dams employed in chip-on-board arrays of LEDs to control the extent of phosphor deposited over LEDs might have some impact on the shape of the edges of the light beam emitted. Phosphor dams feature geometries that are generally much shorter than the width of the individual LEDs or the LED array and that are located relatively far from the edges of the LEDs, e.g. many multiples of the thickness of the LEDs or on the order of the width of the individual LEDs or higher.

2. Adjustment of Beam Pointing

Prior art for forming and directing a light beam in a lighting fixture utilizes a large diversity of designs and aesthetics but with very similar methods. Directional light fixtures generally operate by the shared principle of aiming a combined light engine and optical system. In these systems, the light engine includes at least a light emitting source and circuitry to provide power, and often also a heat sink. The optical system includes one or more reflective or refractive optics to collimate, shape, and mix the light output into a desirable light distribution.

The conventional means for adjustability is to tilt a light source in one or more gimbals, such as in a track light. Early adjustable automotive headlights also employed brute force gimbals, such as in U.S. Pat. No. 1,454,379. However, later developments focused on adjustment mechanisms that did not require wholesale reorientation of the luminaire and reduced the range and vulnerability of the tilting motions, such as using a tilting aperture between a fixed light source and optic to create a moving beam of light as taught by U.S. Pat. No. 2,753,487 to Bone, or using a moving mask between a fixed light source and optic to create a moving dark portion within a broad beam of light as taught by U.S. Pat. No. 2,941,117 to Dugle.

Arrays of tilting light sources have also been disclosed where the light sources may be tilted in unison to adjust the direction of the aggregated light beam, as taught by U.S. Pat. No. 9,562,676 to Holt; where the light sources may be tilted inward or outward from a common axis to contract or expand the aggregated light beam, as taught by U.S. Pat. No. 6,390,643 to Knight; or where the light sources may be tilted tangentially around a common axis to expand the aggregated light beam, as taught by Holt and Knight.

A planar adjustable luminaire design of prior art is disclosed in U.S. Pat. No. 10,048,429 B2 to Ford and William M. Mellette, Glenn M. Schuster, and Joseph E. Ford, "Planar waveguide LED illuminator with controlled directionality and divergence," *Optics Express* vol. 22 No. S3, 2014. This design offers the advantage of a compact low-profile form factor with wide adjustability. The luminaire uses an edge-illuminated lightguide with periodic extraction features that is mated to an array of refractive lenses or reflectors ("focusing elements"). By adjusting the relative location of the extraction features and the focusing elements, the direction of the beam can be steered and the angular width of the output beam can be adjusted. Related designs for planar adjustable luminaires are disclosed in two patent publications by some of the present inventors: U.S. Patent Application Publication 20180/245776A1 by Gladden and U.S. Patent Publication 2018/0087748A1 by Gladden. These applications also describe designs for planar adjustable luminaires using light guides or arrayed light emitters, paired with arrayed collimating optics. PCT/EP2017/081553 to Bory describes mechanical designs for the construction of similar planar adjustable luminaires using arrayed optics. U.S. Pat. No. 7,896,521 to Becker is earlier prior art that describes movement of a lens array relative to an LED array in order to alter beam properties.

3. Configurable Illumination Patterns

To properly light a given space and/or objects, a specific illumination distribution ("lightfield") is desired that is more complex than what a conventional single lighting fixture can emit. Achieving complex and useful lightfields often requires a collection of different light fixtures and can result in significant over-lighting as the output pattern of standard commercial fixtures will not perfectly match the requirements of a given scene. Such over-lighting carries unnecessary additional cost in lighting fixtures and lamps, and results in excessive energy use.

Advanced automotive headlight systems employ a large optic with arrays of LEDs that are addressable individually or in groups, such that addressing different individual LEDs or groups of LEDs results in varying size, shape, and direction of the headlight beam. Varying the brightness of different portions of the beam in these headlight systems might be accomplished primarily by dimming individual LEDs, although this is not generally taught in the prior art or implemented in commercial headlight products. Examples of this prior art include U.S. Pat. No. 6,565,247 to Thominet, U.S. Pat. No. 7,150,552 to Weidel, and U.S. Pat. No. 9,470,386 to Kloos. Such systems are flexible but expensive and difficult to power electrically because of the large number of LEDs which must be individually addressed.

Another means to modify the shape of light beams is to block portions of the light source with a mask between the light source and optic. U.S. Pat. No. 2,941,117 to Dugle and U.S. Pat. No. 6,565,247 to Thominet teach the use of a mask that blocks a portion of the light beam. U.S. Pat. No. 2,753,487 to Bone teaches the use of a tilting aperture over a light source that only allows for light from a small area to reach the optic, effectively creating a tilting spot light source but providing very low optical efficiency.

A novel luminaire design that provides for facile and low-cost customization to produce desired static lightfields was described in U.S. Patent Publication 2018/0087748A1 by Gladden. The design uses a lightguide and an array of collimating optics. Extraction features are fabricated on the lightguide, for example using a printing process, to customize the pattern of the projected beam. By controlling the pattern of extraction features printed on the light guide, any arbitrary lightfield can be produced.

SUMMARY

1. LED Light Source Uniformity and Angular Distribution

Various light mixing structures have been proposed in the prior art to improve color uniformity of light emitters such as LEDs, including diffusers, light pipes, total-internal reflection (TIR) mixing optics, faceted reflectors, and remote phosphors. However, these light mixing structures generally reduce light output efficiency and increase the Light-Emitting surface (LES) area, which are especially undesirable in many directional or advanced lighting applications.

The efficiency challenge occurs because conventional light mixing structures interact with and mix all or nearly all of the light emitted from an emitter, which requires them to either be very long in the primary axis of light propagation, typically at least three times the width of the emitter, or very wide in the plane perpendicular to the primary axis of light propagation, or both. Mixing all or nearly all of the light emitted from an emitter inevitably results in light loss, typically more than 10% of the light emitted from an emitter, which is undesirable since this reduces the energy efficiency of a lighting system. A wide mixing structure increases the LES of the light source, which is undesirable in directional lighting systems because it requires the use of larger optics to achieve the same performance levels.

A further limitation of many emitter sources is their wide range of emission angles, typically a full hemisphere or more. This introduces challenges in the design of optics that must gather the emitted light in order to collimate or focus it to project a desired beam. What is needed is a mixing structure that is compact and high optical efficiency, and that can also optionally provide collimation of the mixed light in order to improve the design of fixtures for projecting uniform illumination beams with high efficiency.

2. Adjustment of Beam Pointing

In conventional directional luminaires, the combined size and mass of the optical system along with the light engine presents numerous challenges, including placing directional lights in confined spaces or in close proximity to each other. In addition, the aesthetic impact of a multitude of directional lights aimed in different directions is often considered unappealing.

The planar adjustable luminaires of prior art can limit the need to move the light engine in order to adjust the direction of an emitted beam. However, the prior art does not teach optimized optical designs for refractive lensing systems. Further, in utilizing arrayed optical elements, especially when paired with a lightguide, prior art designs are limited in compactness. Arrayed sources also create multiple shadows when illuminating objects, which can be undesirable. What is needed is a compact design for a directional light with adjustable beam pointing from a single source.

3. Configurable Illumination Patterns

The lightguide-based approach of prior art to achieving configurable illumination patterns can produce complex lightfields with high fidelity and low cost. However, achieving high efficiency in these luminaires is difficult. The optical issue is that light may be efficiently coupled into a lightguide, but it must be extracted rapidly within a short distance before significant absorption, scatter, and reflection losses decrease efficiency, which means a large area of the lightguide must be populated with extraction features. Further, in many applications, the high potential fidelity of the customized lightfield luminaire is not necessary, especially where the current practice is to build an illumination distribution with a mixture of several conventional lighting fixtures featuring relatively large and simple beams. What is needed is a design for producing configurable illumination patterns with high efficiency from a compact luminaire.

Described herein are a number of approaches to providing improved beam quality, adjustability, and configurability in luminaires.

In accordance with one preferred embodiment, a luminaire may adjust or control the direction of the emitted light beam. The luminaire includes an emitting source and a refractive optical system that steers an emitted beam by relative translation of the emitting source against the optical system. The light emitting source may be placed along an optical axis of one or more lenses to produce an output beam along that axis, or translated in-plane (orthogonal to the optical axis) relative to the lenses to produce a steered beam. The optical system may include refractive lenses and in some embodiments mixing channels and/or one or more baffles with apertures. The design is typically optimized to produce a round, uniform beam that retains approximately the same power level and beam width as it is steered. It is beneficial, but not required, that a second lens have a diameter equal to or larger than a first lens, and be of lower optical power. The lenses may be configured so that the effective focal plane of the two lenses together is located approximately at the plane of the light emitting source.

In another aspect, a preferred embodiment is a mixing channel for improving the uniformity of color and intensity of a light emitting source, such as a light emitting diode. The mixing channel may be hollow, and preferably has an interior surface of high reflectivity. It preferably fits tightly around the diameter or diagonal of the source, and preferably is of sufficiently short length to interact with less than 50% of the emitted light from the source. In a further preferred embodiment, the mixing channel flares from a smaller dimension around the light emitting source to a wider dimension at the optical exit aperture, providing the cross-sectional shape of a compound parabolic concentrator.

In yet another aspect, a preferred embodiment is a luminaire consisting of a circuit board populated by light emitters in certain locations and an optical layer that contains one or more arrays of lenses. The locations of the light emitters can be adjusted during the design or population of the circuit board in order to customize the lighting distribution produced by the luminaire. The circuit board may optionally contain a dense array of such locations, so that any subset may be populated as desired. Further, the circuit board may optionally contain more than one circuit, so that different lighting distributions can be produced by the luminaire by activating different circuits.

BRIEF DESCRIPTION OF THE DRAWINGS

A further understanding of the nature and advantages of the preferred embodiments may be realized by reference to the following portions of the specification and the accompanying drawings.

FIG. 7(*a*) shows a mixing channel of circular shape and increasing width forming a cone shape. FIG. 7(*b*) shows a mixing channel of rectangular shape and increasing width forming a rectangular cone shape. FIG. 7(*c*) shows a mixing channel of circular shape and cross-section of a compound parabolic concentrator. FIG. 7(*d*) shows a mixing channel of rectangular shape and cross-section of a compound parabolic concentrator.

In FIG. 8(*a*) the transparent material is not in contact with the light emitter; in FIG. 8(*b*) the transparent material is in intimate contact with the light emitter; in FIG. 8(*c*) the transparent material has a textured surface at the output opening of the mixing channel.

In FIG. 9(*a*) the mixing channel is attached by adhesive; in FIG. 9(*b*) by mechanical retention; in FIG. 9(*c*) by solder.

In FIG. 13 (*a*) a light emitter is placed near the focus of a lens. In FIG. 13(*b*) a light emitter is placed out of the focus of a lens. FIG. 13(*c*) shows a light emitter and mixing channel where the output opening of the mixing channel is near the focus of a lens.

FIG. 14(*a*) shows a light emitter centered with respect to a two-lens optic, producing a centered light beam. In FIG. 14(*b*), the light emitter has been shifted laterally so that its center is no longer aligned with the axis of the two-lens optic, producing a steered light beam. In FIG. 14(*c*), the two-lens optic is instead shifted relative to the light emitter, producing the same steered beam.

FIG. 15(*a*) shows one planoconvex and one double-convex lens, FIG. 15(*b*) shows two planoconvex lenses with plano surfaces outward, FIG. 15(*c*) shows two planoconvex lenses with plano surfaces inward, FIG. 15(*d*) shows two double-convex lenses.

FIG. 18(*a*) shows the optical axes of the two lenses centered with respect to the light emitter, resulting in a centered light beam. FIG. 18(*b*) shows the optical axes of the lenses shifted relative to the light emitter, with the lens furthest from the light emitter shifting more than the lens closer to the light emitter resulting in a steered light beam.

In FIG. 19(*a*) the surfaces of the lenses are smooth, while in FIG. 19(*b*) some surfaces are textured.

In FIG. 20(*a*) the texturing is uniform on a surface, and in FIG. 20(*b*) the texturing varies across the faces of the lenses.

In FIG. 21(*a*) a single light emitting source is used. In FIGS. 21(*b*) to 21(*d*), multiple coplanar individually addressable light emitting sources are used. In FIG. 21(*b*) the center emitter is activated to produce a centered beam. In FIGS. 21(*c*) and 21(*d*), edge emitters are activated to produce steered beams without movement of the lens optics.

In FIG. 22(*b*) the iris is contracted relative to FIG. 22(*a*), resulting in a narrower light beam. In FIG. 22(*c*) the iris is expanded relative to FIG. 22(*a*), resulting in a wider light beam.

FIG. 24(*a*) depicts beam-steering by orthogonal two-axis translation. FIG. 24(*b*) depicts beam steering by linear relative radial motion along with rotation about the optical axis.

In FIG. 26(*b*) this distance is increased relative to FIG. 26(*a*), resulting in a wider light beam; in FIG. 26(*c*) this distance is reduced relative to FIG. 26(*a*), resulting in a narrower light beam.

In FIG. 27(*a*) the arrays are aligned so that the optical axes of the lenses are centered relative to the light emitters, creating centered light beams. In FIG. 27(*b*) the lens arrays are shifted relative to the light emitters, creating steered light beams. In FIG. 27(*c*), the lens arrays are rotated relative to the light emitter array, causing the relative shift to vary for each set of emitter and lens optics, resulting in light beams that point in various directions and aggregate to a wider total light beam out of the fixture.

DETAILED DESCRIPTION OF ONE OR MORE PREFERRED EMBODIMENTS

Part 1: Light Mixing Channels

Figure 1:
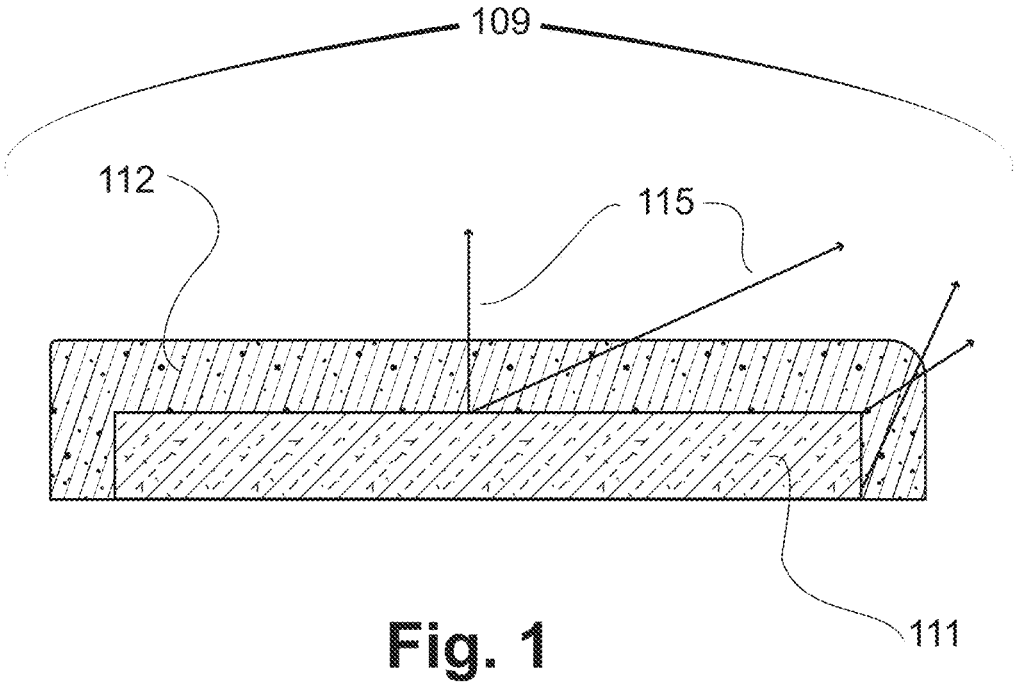
FIG. 1 depicts the different paths for light in a prior art phosphor-coated LED versus light emission angle and position, which cause variations in color and intensity.
Figure 2:
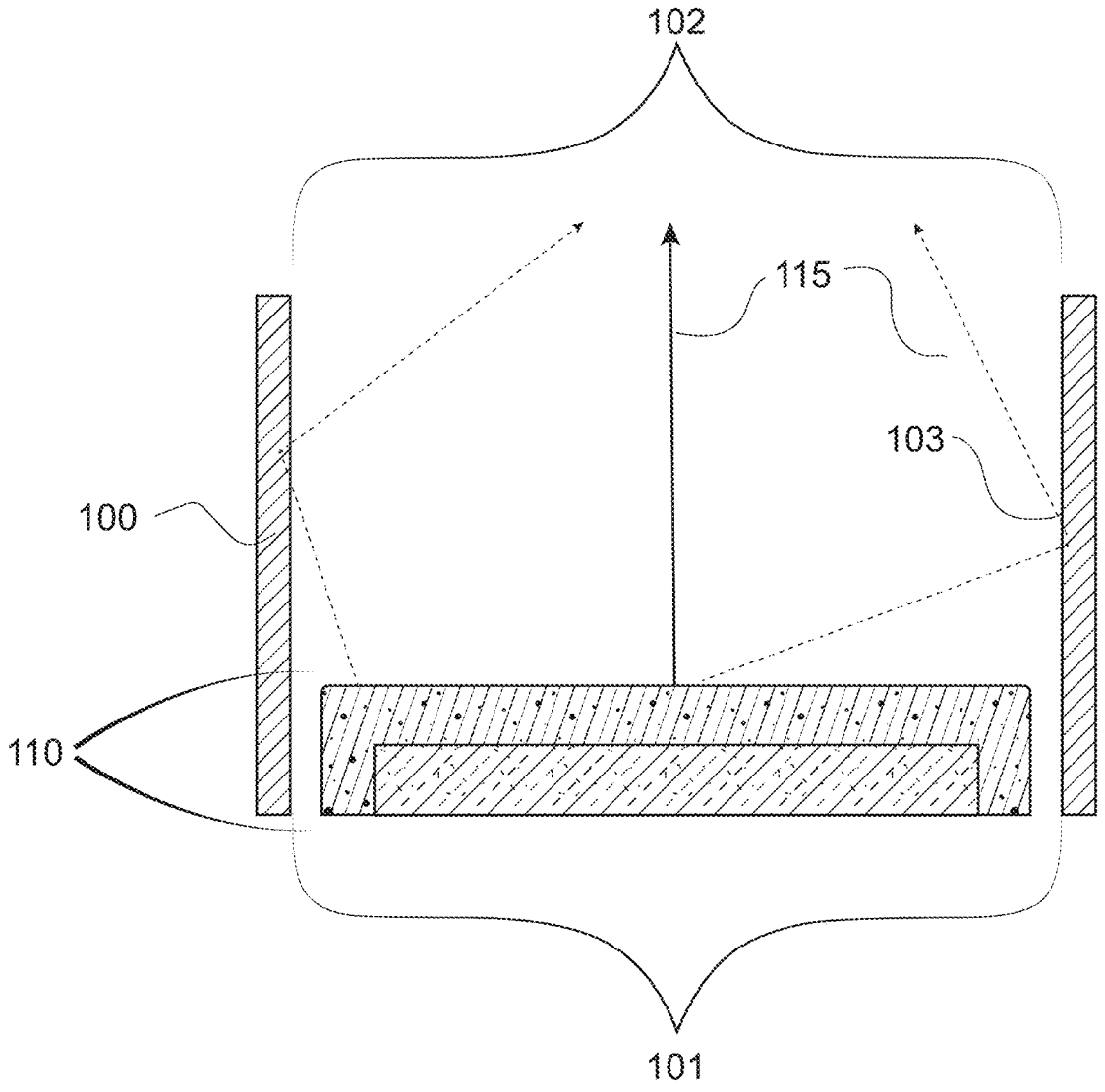
FIG. 2 shows a light emitter placed inside a light mixing channel designed to preferentially mix light emitted from the edges of the emitter and light emitted at low angles from the emitter.
Figure 3A:
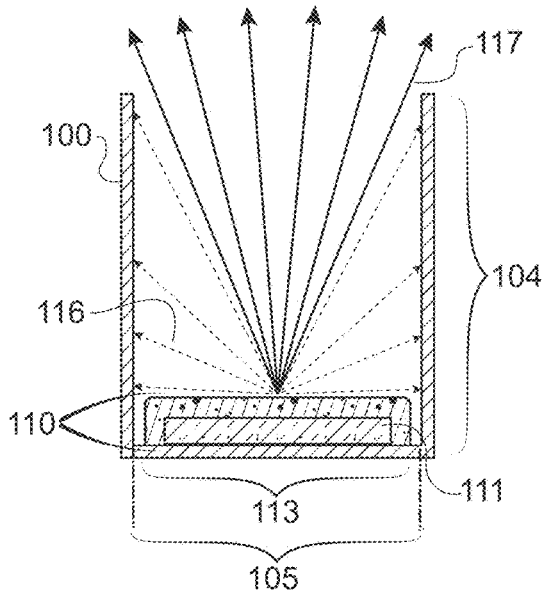
FIGS. 3(*a*) to 3(*f*) depict light mixing channels of different length and how they selectively interact with light emitted at low angles and from the edges of the emitter.
Figure 3B:
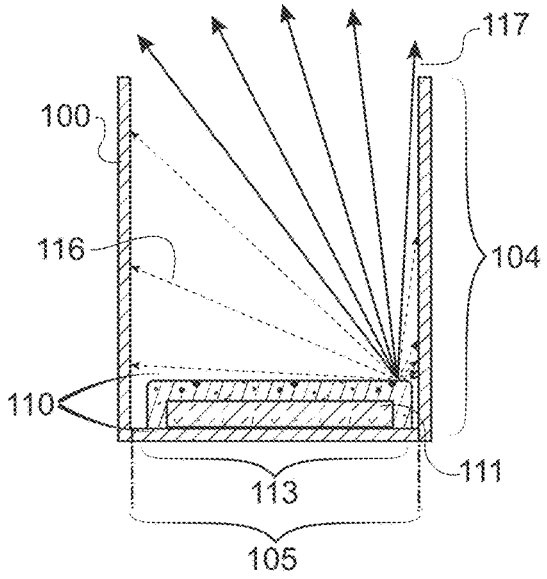
Figure 3C:
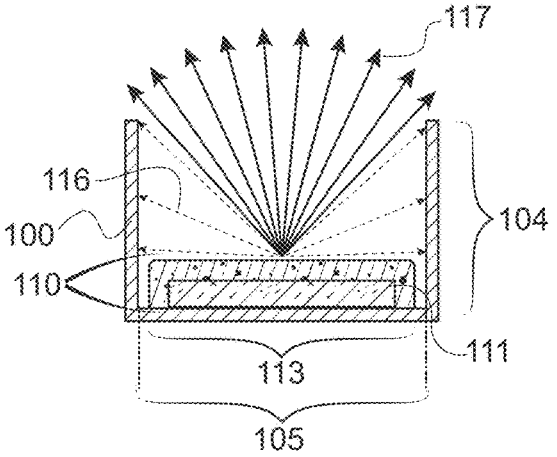
Figure 3D:
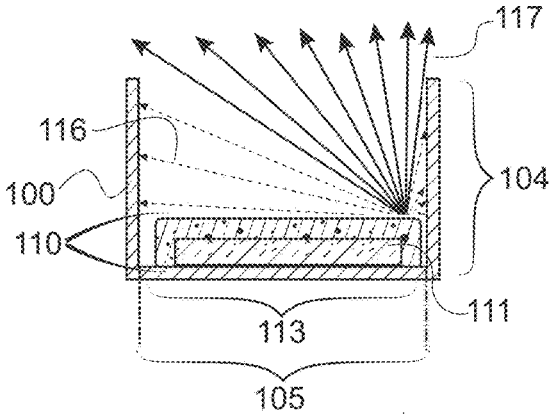
Figure 3E:
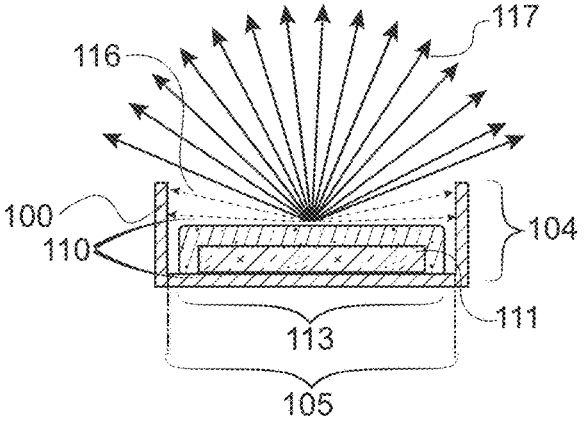
Figure 3F:
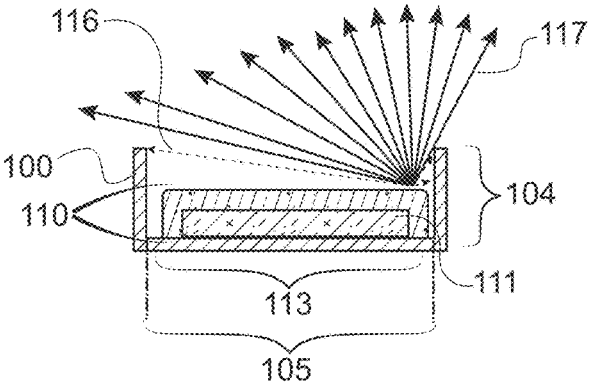

A preferred embodiment is shown in FIG. 2, where a mixing channel 100 and a light emitter 110 are paired together. The mixing channel 100 has at least two openings. An input opening 101 is placed around all or most all of the periphery of the light emitter, such that all or a substantial portion of the light emitted by the light emitter 110 enters the mixing channel 100. Light emitter 110 may be a single LED (phosphor-converted or not), an array of LEDs (phosphor-converted or not), an array of LEDs covered with a common phosphor conversion layer, or another light emission source. In FIGS. 1, 2, 3, 7, and 8, a single phosphor-converted LED is shown. An output opening 102 allows for light to exit the mixing channel 100. The mixing channel 100 has a reflective inner surface 103 and shape designed to provide sufficient light mixing such that the light exiting the output opening 102 opposite the emitter 110 has little to no visible color variation and has measured color variation less than the relevant specification, which in many cases is less than 0.006 points of maximum variation from the average color of the light beam as measured in u'v' color space.

When the emitter 110 is a phosphor-converted LED 109, the majority of color non-uniformity occurs at low angles of light emission (i.e. angles far from perpendicular to the emission surface of the LED 109) or is localized to near the edges of the LED 109, or both, as shown in FIG. 1. Therefore, the mixing channel 100 is designed so that the inner reflective coating 103 selectively interacts with and mixes light that is emitted at low angles from or localized to near the edges of the emitter, or both.

Mixing Channel Dimensions

The length of the mixing channel 100 is preferably short compared to the effective optical path length of conventional light mixing structures. FIG. 3 (*a*) through FIG. 3 (*f*) show how a mixing channel 100 with a length 104 typically less than three (3) times the width 113 of the associated light emitter 110, more selectively mixes light emitted by at light emitter 110 at low angles, emitted from near the edges, or both, as the mixing channel becomes shorter. FIGS. 3(*a*) and 3(*b*) show a long mixing channel 100, FIGS. 3(*c*) and 3(*d*) show a medium-length mixing channel, and FIGS. 3(*e*) and 3(*f*) show a very short mixing channel. In each such FIG. 3(*a*)-3(*f*), light rays are shown emerging from a single location. Light rays 116 are rays that interact with the mixing channel, while light rays 117 do not hit the interior surface 103 of the mixing channel. FIGS. 3(*b*), 3(*d*), and 3(*f*) show that light rays emanating from near the edge of the LED die 111 interact more with the longer channel than the shorter one. The same is true for light rays emanating from the center of the die, as shown in FIGS. 3(*a*), 3(*c*), and 3(*e*).

The width 105 of the mixing channel is typically less than three (3) times the width 113 of the associated light emitter 110, while more conventional light mixing approaches are typically much larger. The mixing channel width 105 is made large enough to capture all or most of the light emitted by the light emitter, but kept as small as possible to minimize the length 104 of mixing channel required to get sufficient light mixing and to maximize the selectivity of the mixing channel to light emitted from near the edges of the light emitter.

Figure 4:
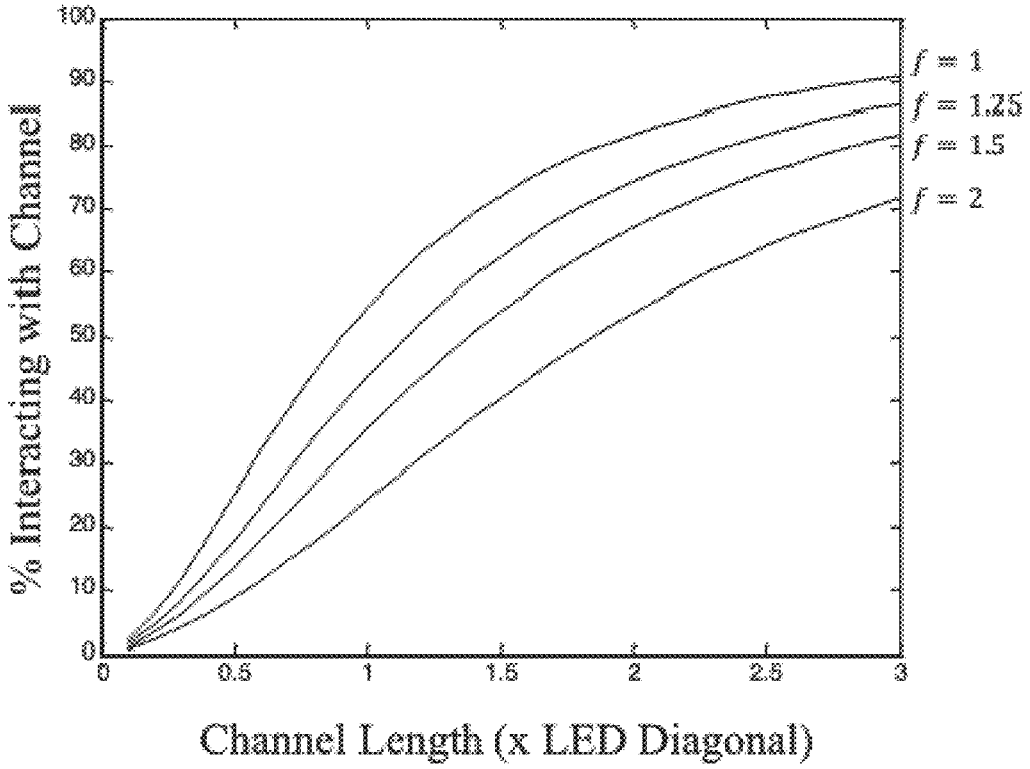
FIG. 4 shows results of a simulation indicating what fraction of light emitted by an emitter interacts with the mixing channel as a function of mixing channel height (length), relative to the dimensions of the light emitter. The parameter f represents the channel width divided by the diameter (or diagonal if square) of the emitter.

The length 104 and width 105 of the mixing channel may be inter-related and designed together so that the mixing channel mixes the fraction of light that contains the majority of the color non-uniformity of the light emitter. FIG. 4 shows the percentage of light emitted from a light emitter with a Lambertian output pattern that interacts with a cylindrical mixing channel as a function of the length and width of the mixing channel.

In some embodiments, the light emitter 110 has a width 113 of 0.5 mm to 15 mm, the mixing channel length 104 has a length of 0.1 mm to 45 mm, and the mixing channel width 105 has a width of 0.7 mm to 30 mm.

The preceding discussion has focused primarily on light mixing for color uniformity, while irregularities in light intensity may also occur. Light intensity irregularities in LEDs primarily originate from the edge of the LED die by mechanisms similar to what cause color non-uniformity at the LED die edges, hence mixing channels may also be properly designed to improve color uniformity also smooth out light intensity irregularities.

Mixing Channel Shape

Figure 5A:
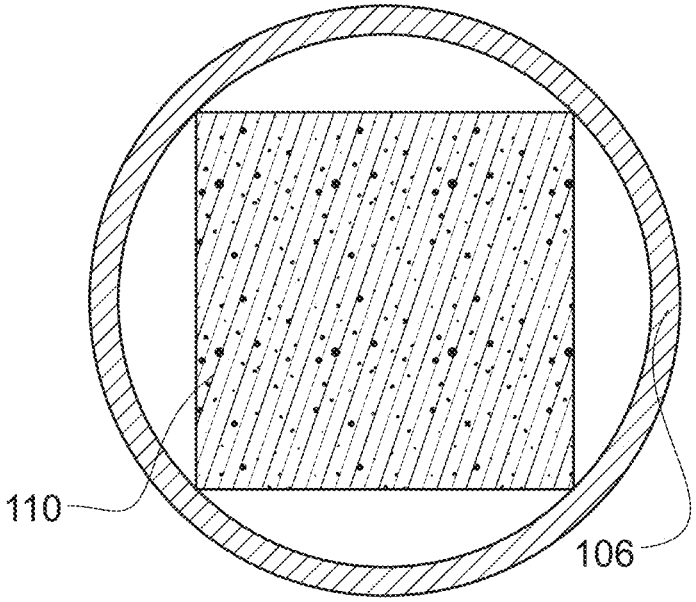
FIGS. 5(*a*) and 5(*b*) show a mixing channel with a round cross-section, circumscribing a square light emitter, in plan view in FIG. 5(*a*) and perspective view in FIG. 5(*b*).
Figure 5B:
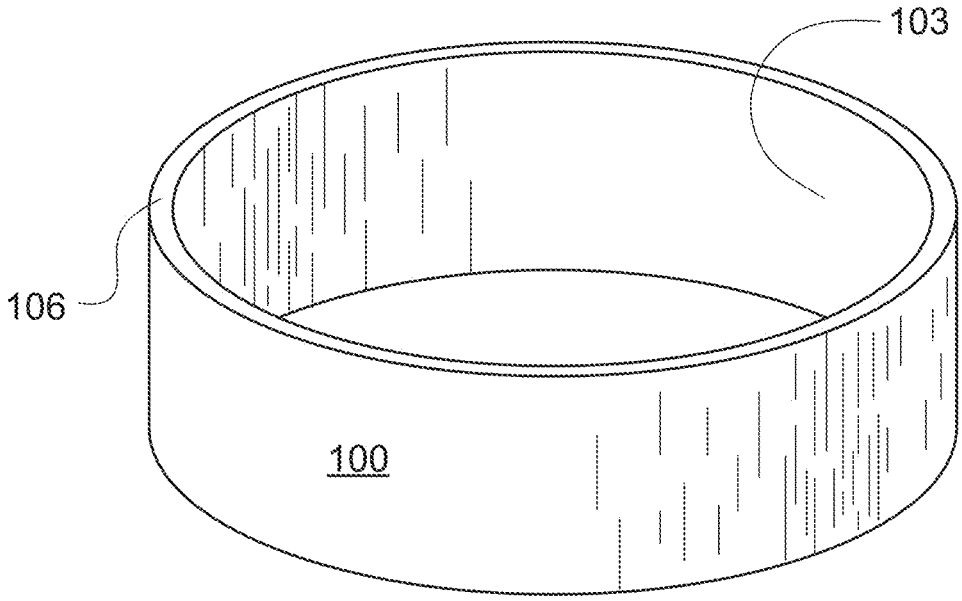

The mixing channel may be constructed with several different cross-sectional shapes, while retaining its overall function. One preferred embodiment is a round cross-section 106, as shown in the top view of FIG. 5(*a*) and the isometric view of FIG. 5(*b*), because it features the smallest cross-sectional area for a given mixing channel width and it tends to result in a round projected light beam that is desirable both as a commonly used light beam shape and an optically simple beam shape for further optical manipulation.

Figure 6:
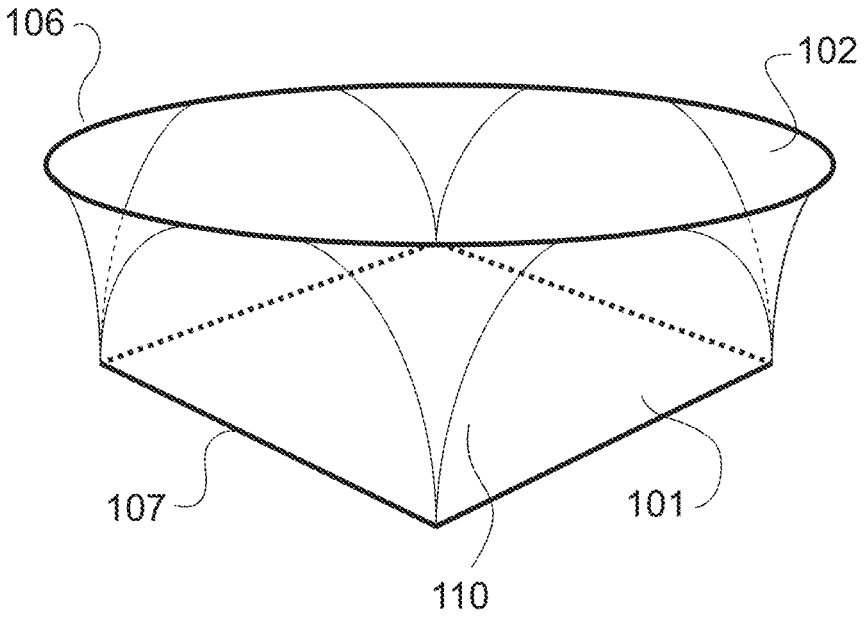
FIG. 6 shows a mixing channel whose shape changes from square at the input opening where the emitter is placed to round at the output opening.
Figure 7A:
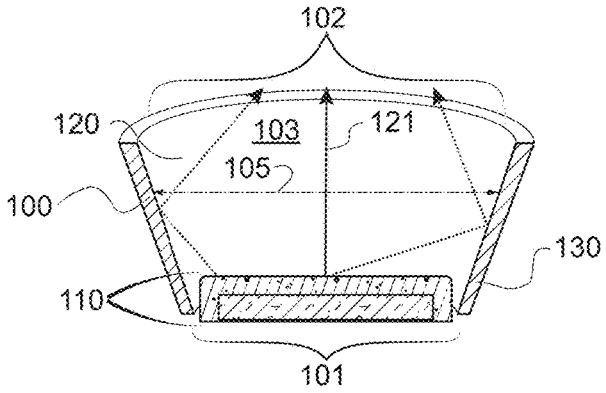
FIGS. 7(*a*) to 7(*d*) show cross-section views of various mixing channels with width that increases from the input aperture to the output aperture.
Figure 7B:
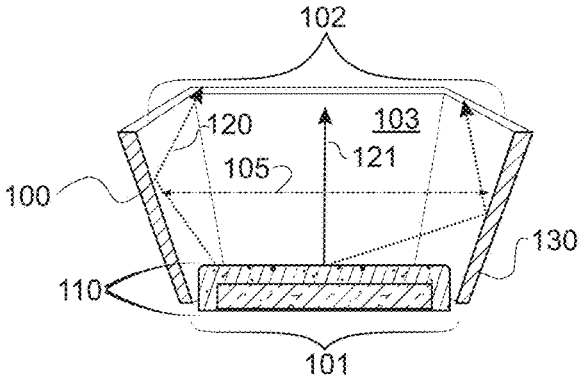
Figure 7C:
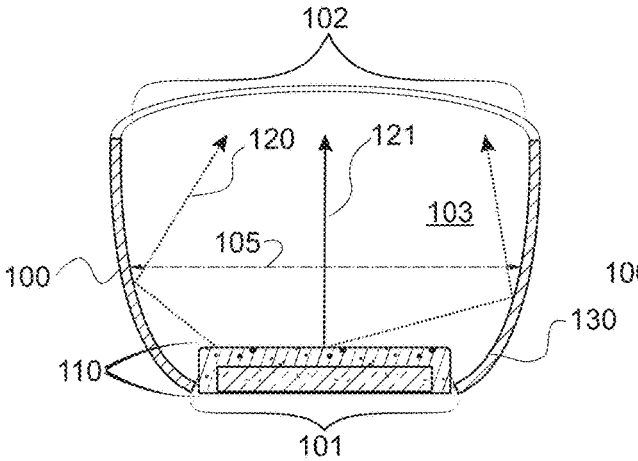
Figure 7D:
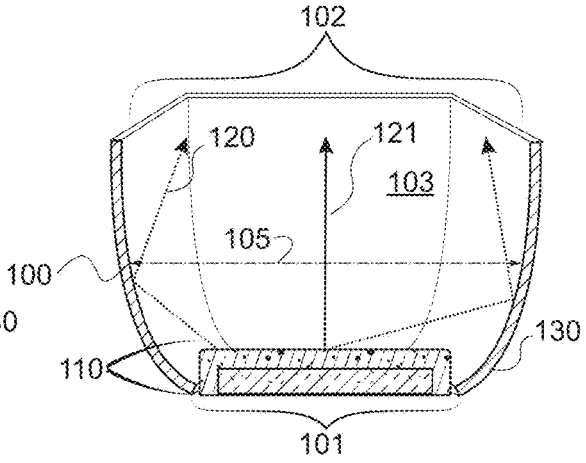

The cross-sectional shape and width may also vary along the length of the mixing channel 100 to provide optical or mechanical advantages, while retaining its overall function. One preferred embodiment, shown in FIG. 6, has a rectangular cross-section 107 at the input opening 101 of the mixing channel 100 placed at the light emitter 110, and tapers to a round cross-section 106 at the opposite output opening 102 of the mixing channel. This shape can capture as much light as possible from the light emitter 110 while retaining a small cross-sectional area at the output opening.

FIG. 7(*a*) shows an embodiment in which the inner surface 103 of the mixing channel is a specular reflector and the width of the mixing channel 100 increases from the input opening 101 to the round output opening 102. In this case, light rays 120 originally emitted by the light emitter 110 at low angles are reflected by the inner surface 103 and emerge through the output opening 102 at higher angles. Light rays 121 originally emitted by the light emitter 110 at higher angles are not reflected and maintain their angle. As a result, the overall distribution of light ray angles is narrowed, so that the mixing channel 100 also provides a collimating function in addition to a light mixing function. Collimation of the light rays can be valuable in simplifying the design and improving the performance of directional luminaires.

Such collimating mixing channels 130 can be provided in a wide range of designs, including both round cross section, as shown in FIG. 7(*a*) as well as a rectangular cross section, as shown in FIG. 7(*b*). The width 105 of the collimating mixing channel 130 can grow linearly between the input opening 101 and the output opening 102, producing a cone shape, as in FIGS. 7(*a*) and 7(*b*), or with a more complex dependence. In one preferred embodiment, shown in FIG. 7(*c*), the width 105 of the collimating mixing channel 130 varies along its height so as to produce a compound parabolic concentrator, a design which is known in the art to provide the most efficient possible collimation in the smallest possible area. A collimating mixing channel of compound parabolic concentrator design may be achieved with either a round cross section as shown in FIG. 7(*c*) or with a rectangular cross-section as shown in FIG. 7(*d*).

Mixing Channel Inner Surface

The reflective inner surface 103 of the mixing channel 100 may be fabricated in several different ways. One preferred embodiment is to employ a highly reflective white material in order to obtain efficient light mixing via scattering while minimizing light absorption at the inner surface of the mixing channel. Another preferred embodiment is to employ a highly reflective specular mirror coating, in order to obtain light mixing while minimizing both light absorption at the inner surface of the mixing channel and light reflected back toward the light emitter.

In some embodiments, the reflective inner surface 103 is comprised of white paint, titanium dioxide, aluminum, silver, gold, rhodium, chromium, nickel, or a dielectric multilayer structure.

The mixing channel inner surface 103 need not be smooth or made of a single reflective material layer. The inner surface of the mixing channel may be fabricated to provide asymmetric reflection, such that more light is reflected toward the output opening of the mixing channel versus back toward the light emitter. Asymmetric reflection may be provided by asymmetric coatings, patterns of raised or depressed features, and circumferential grooves or ridges. The reflective inner surface of the mixing channel may be fabricated to be partly transparent, allowing for some light to escape the sides of the mixing channel and changing the overall light emission pattern of the system. Finally, multilayer reflective materials may be used inside the mixing channel to provide for highly efficient reflection.

Material Inside Mixing Channel

The mixing channel 100 may have a hollow volume within the inner reflective surface, thus filled by air or some other gas. A hollow mixing channel has the advantage of no Fresnel reflections at the input or output openings of the mixing channel that may result in loss of light.

Figure 8A:
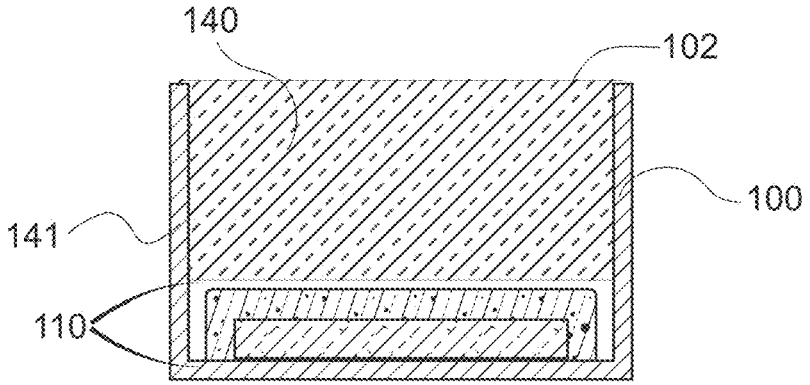
FIGS. 8(*a*) to 8(*c*) show mixing channels filled with transparent material.
Figure 8B:
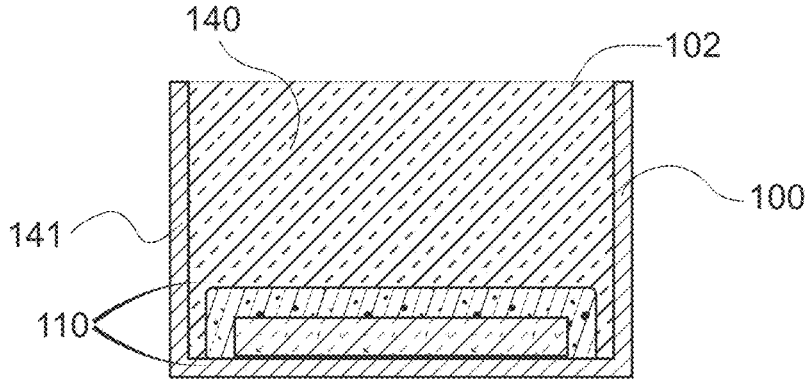
Figure 8C:
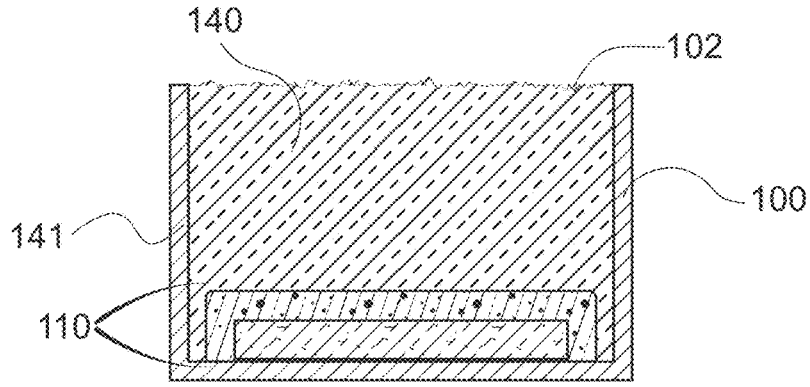

The mixing channel 100 may alternatively be filled with a transparent material 140, as shown in FIGS. 8(*a*), 8(*b*), and 8(*c*). In some embodiments, the transparent material 140 provides a physical support for the fabrication of the mixing channel walls 141. In FIG. 8(*a*), the transparent material 140 is separated from the light source 110 by a small gap. Alternatively, the transparent material may be in direct contact with the light emitter 110, as shown in FIG. 8(*b*). This configuration can improve the efficient in-coupling of light from the emitter into the mixing channel. In another embodiment shown in FIG. 8(*c*), the surface of the transparent material 140 at the output opening 102 of the mixing channel 100 is roughened or textured to enable efficient out-coupling of light from the mixing channel.

In some embodiments, the transparent material 140 may have a refractive index of 1 to 3; in some preferred embodiments, the transparent material 140 may have a refractive index of 1.3 to 1.6. In some embodiments, the transparent material 140 may be a transparent crystal, glass, or polymer; in some preferred embodiments, the transparent material 140 is a silicone, polymethyl methacrylate, polycarbonate, or epoxy.

Mixing Channel Fabrication

Figure 9A:
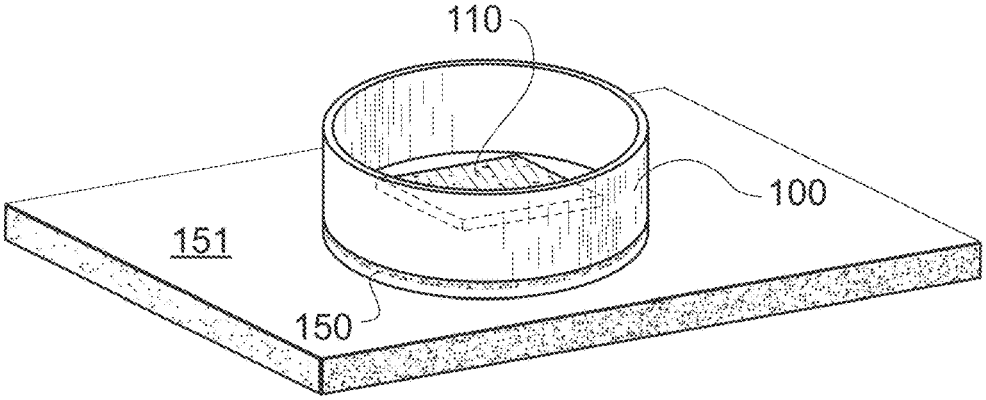
FIGS. 9(*a*) to 9(*c*) show mixing channels attached to a circuit board.
Figure 9B:
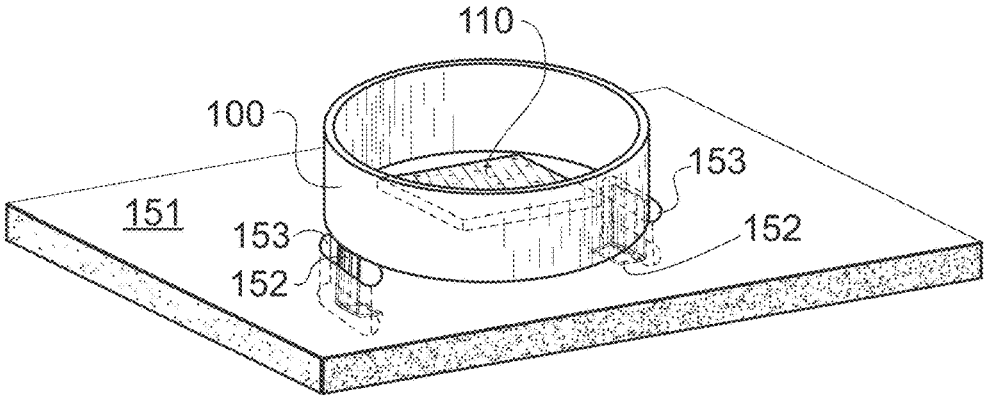
Figure 9C:
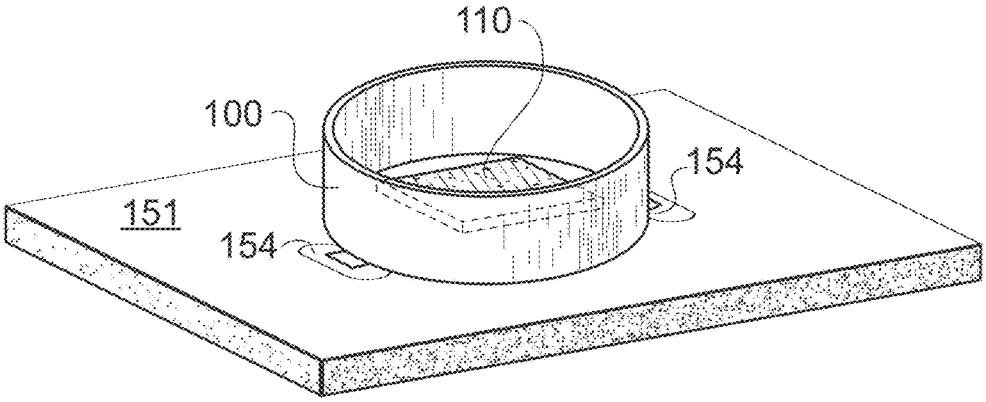

In some embodiments, the mixing channel 100 may be fabricated separately from the light emitter 110 and be secured to the light emitter 110 or to a circuit board that the light emitter is attached to by several means, including adhesives or cements, mechanical retention, or soldering. FIG. 9(*a*) through 9(*c*) shows examples of attaching mixing channels to circuit boards. In FIG. 9(*a*), the mixing channel 100 is attached using adhesive 151 to the circuit board 150, so that the mixing channel 100 surrounds the light emitter 110, which is also attached to the circuit board 150. In FIG. 9(*b*), the mixing channel 100 is fabricated with one or more tabs 152 to enable attachment to the circuit board 150. The tabs 152 are mechanically attached by insertion into through-holes or vias 153 in the circuit board 150. In FIG. 9(*c*), the mixing channel 100 is attached to the circuit board 150 using solder 154, for example in a surface-mount attachment process.

Figure 10:
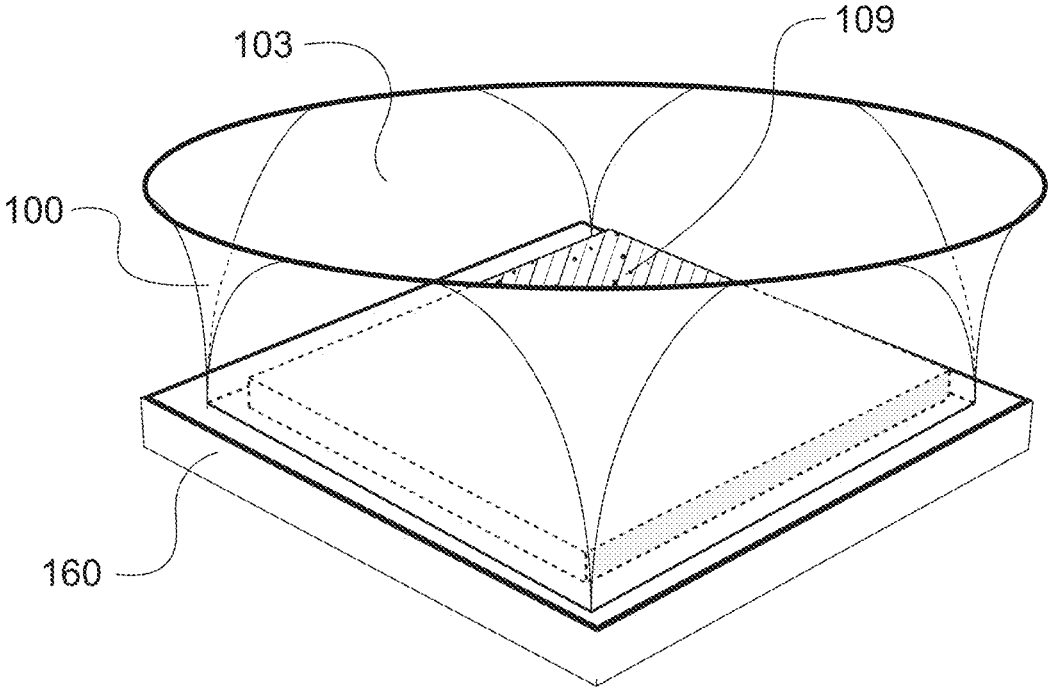
FIG. 10 shows a mixing channel attached directly to LED package.

FIG. 10 shows an example of attaching a mixing channel 100 directly to a submount 160 portion of an LED light emitter 109. The mixing channel 100 may be fabricated as a metal, ceramic, or plastic tube with an inner reflective surface 103 that is polished, coated with a specular reflective or white reflective coating, or lined with a reflective material that is metallic, white, or comprised of a multi-layer dielectric film.

Figure 11:
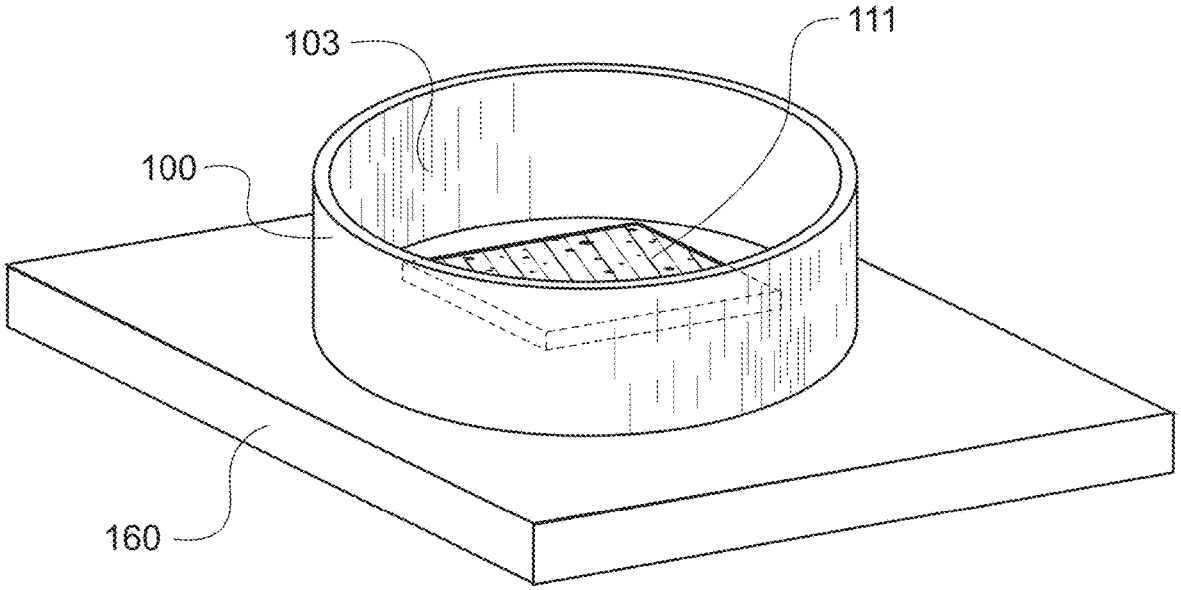
FIG. 11 shows a mixing channel formed integrally to the LED package.

FIG. 11 shows another embodiment in which a mixing channel 100 is formed integrally as a portion of the submount 160. This may be accomplished by several means including molding and dispense of reflective material around the LED 111, or the mixing channel may be pre-fabricated with reflective material onto the supporting lead frame or tile used as a support for the LED die 111.

Figure 12:
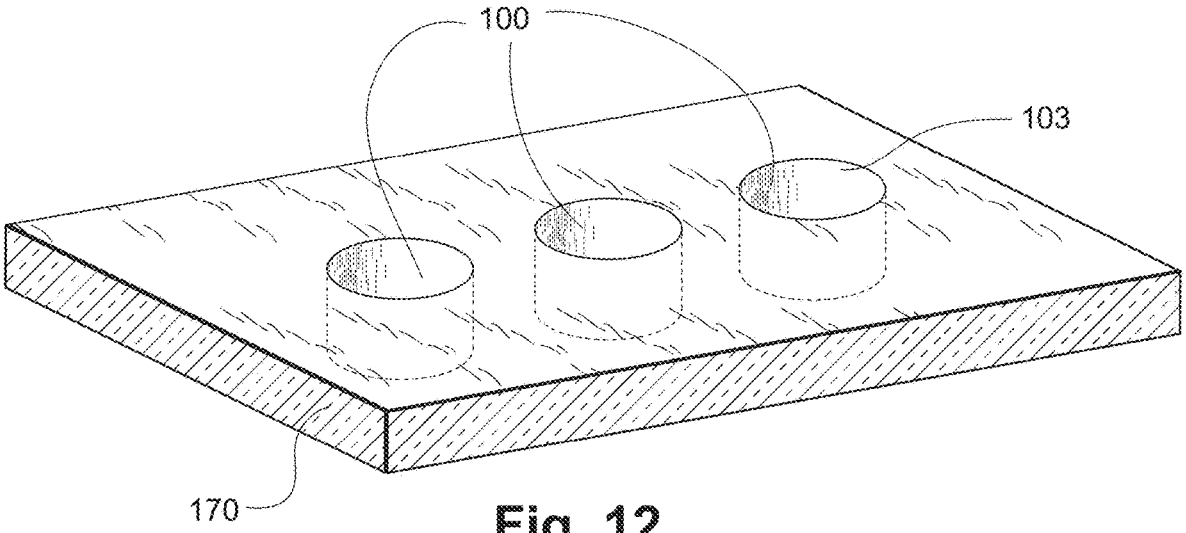
FIG. 12 shows mixing channels fabricated as channels through a sheet of transparent material.

FIG. 12 shows an embodiment in which an array of mixing channels 100 is formed as channels through a sheet 170 of material. The sheet 170 may optionally be a transparent material such as glass, silicone, acrylic, polycarbonate, or other plastic. The inner reflective surfaces 103 may be polished, coated with a specular reflective or white reflective coating, or lined with a reflective material that is metallic, white, or comprised of a multi-layer dielectric film.

Mixing Channel Integration with Optics

Light emitters with mixing channels incorporated are advantageous in many optical systems. In optical systems with any significant focusing power, further improvement in color uniformity may be obtained by utilizing mixing channels.

Figure 13A:
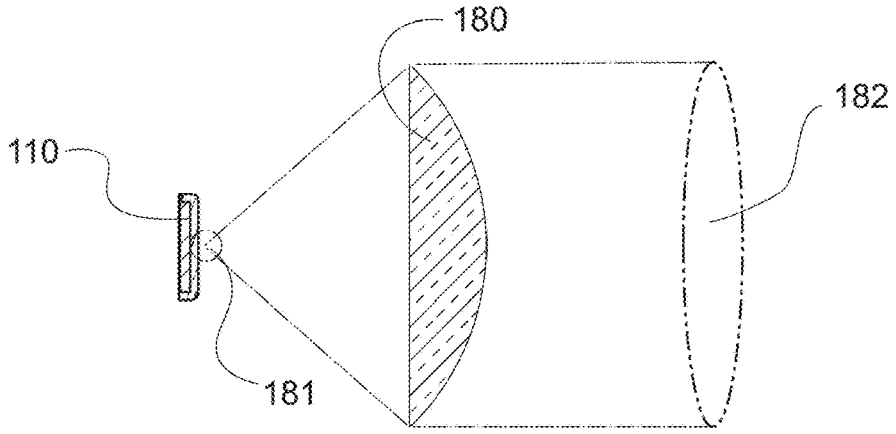
FIGS. 13(*a*) to 13(*c*) show variation of projected beam size.
Figure 13B:
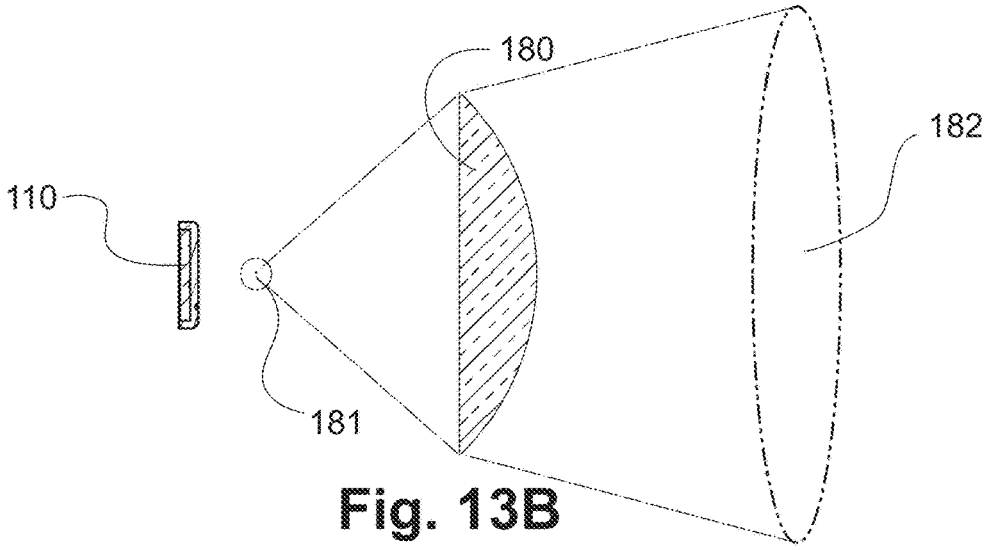
Figure 13C:
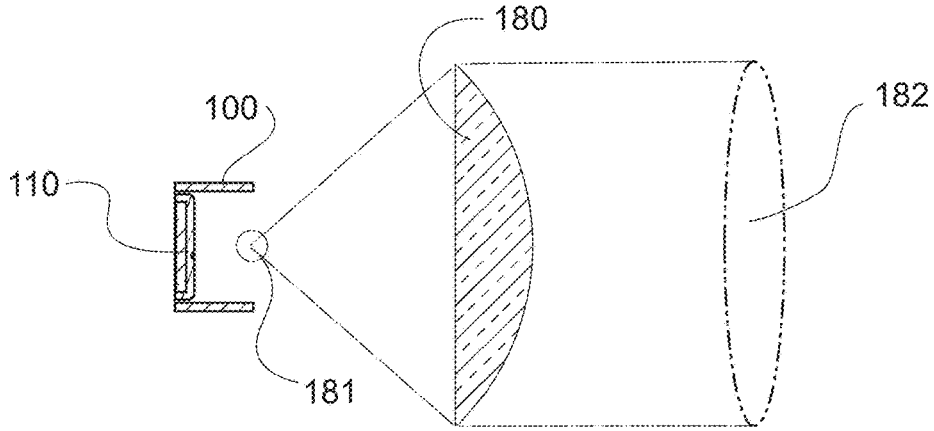

FIG. 13(*a*) shows an example in which a light emitter 110 is placed at the approximate focal plane 181 of an optical system 180 with shallow depth of field, to project a beam 182. The optical system 180 is represented as a single refractive lens, but could be a collection of lenses and/or reflective optical elements. The projected beam 182 in FIG. 13(*a*) will show undesirable variations in color and/or intensity uniformity arising from the properties of the emitter 110. As shown in FIG. 13(*b*), the light emitter 110 may be moved out of the focal plane 181 in order to blur the variations in color and intensity of the emitter, but this will also expand the overall size of the projected beam 182 exiting the optical system, which is undesirable in many applications where focused directional lighting is desired. In particular, a fast focal ratio optical system with shallow depth of field is desirable in many cases and provides for a rapid increase in the circle of confusion versus defocus, but also results in a very rapid increase in light beam size vs defocus.

In FIG. 13(*c*), the system is improved by the addition of a mixing channel 100. The output end 102 of the mixing channel may be placed at or near the focal plane of the optical system 180. The effective size of the light source is then the width of the mixing channel, which may be kept close to the size of the emitter 110, thus the color and intensity variations of the light emitter are blurred without an undesirably large increase in the light beam 182 exiting the optical system.

These examples are not exhaustive, and other useful implementations will, in light of the above, now be evident to those skilled in the art.

Part 2: Optics for Adjustable Beam Pointing

Figure 14A:
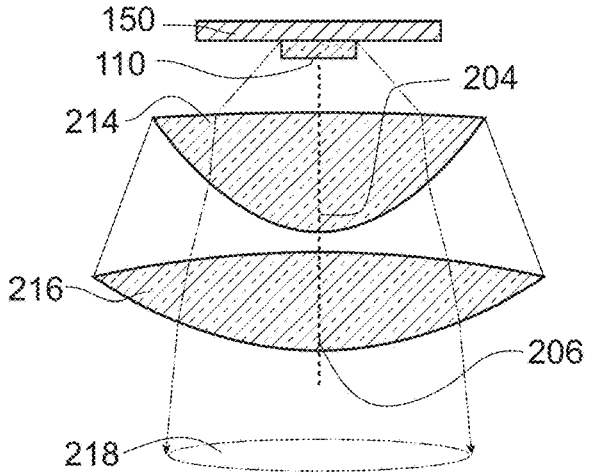
FIGS. 14(*a*) to 14(*c*) show cross-sectional views of an adjustable lighting fixture.
Figure 14B:
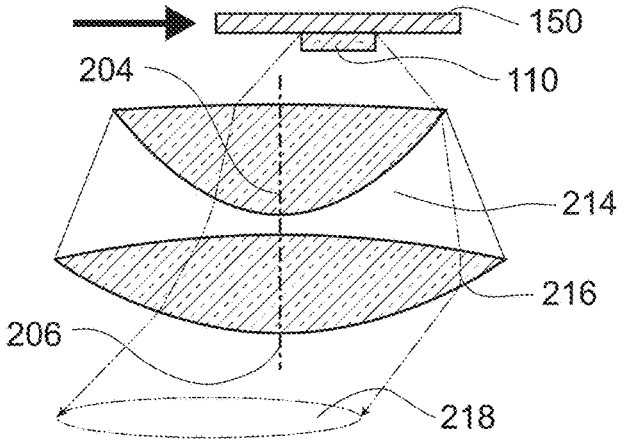
Figure 14C:
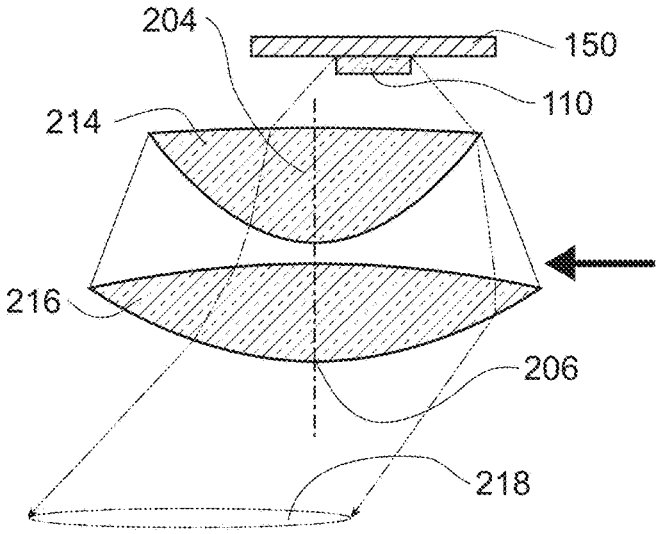
Figure 15A:
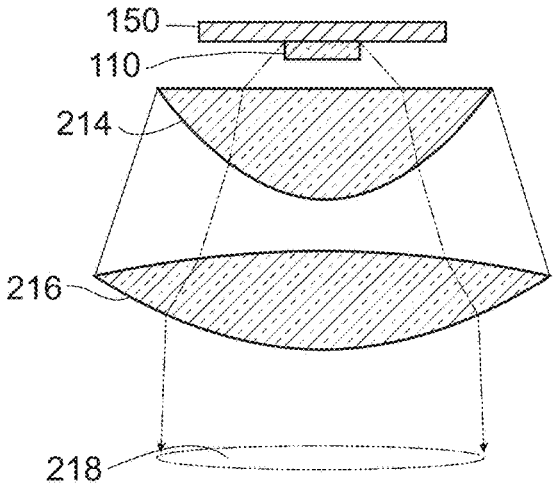
FIGS. 15(*a*) to 15(*d*) show cross-sectional views of various embodiments of the two-lens optic.
Figure 15B:
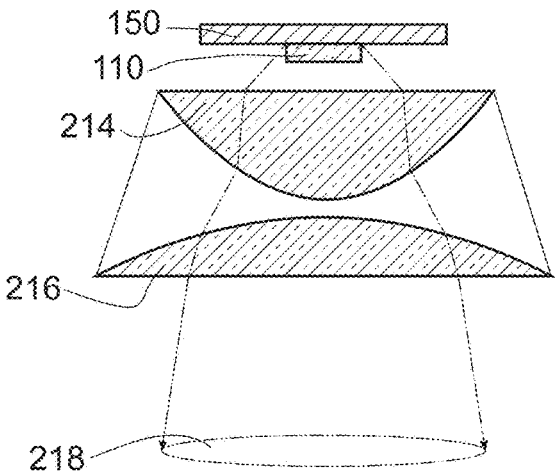
Figure 15C:
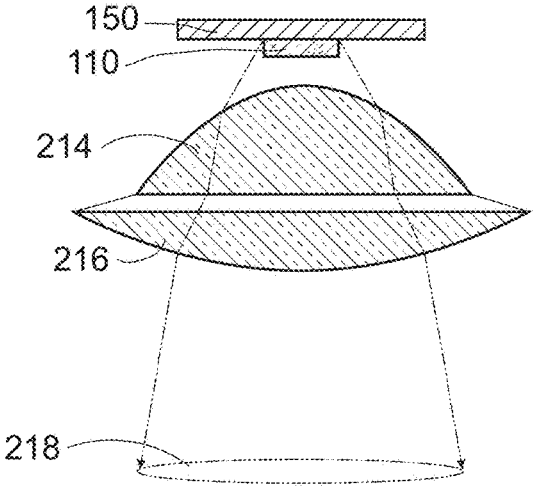
Figure 15D:
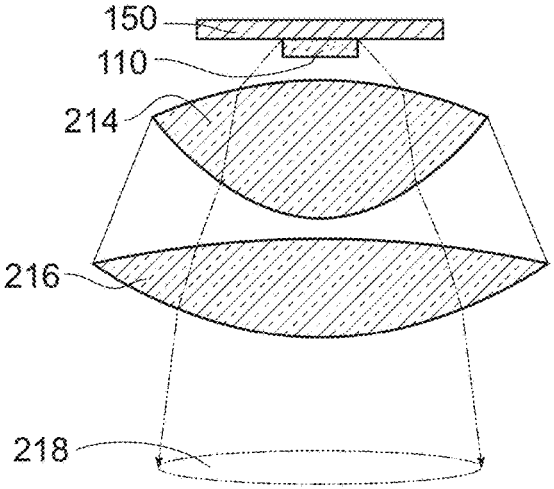
Figure 16A:
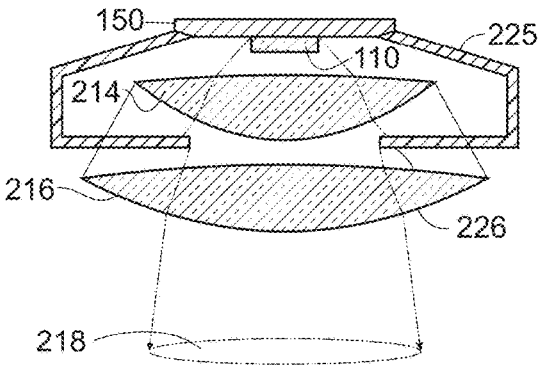
FIGS. 16(*a*) through 16(*f*) show cross-sectional views of adjustable lighting fixtures with baffles to occlude undesirable light. A baffle placed between the two lenses and fixed in position with respect to the light emitter is shown in FIG. 16(*a*) with centered lenses and in FIG. 16(*b*) with shifted lenses. A baffle placed between the two lenses and fixed in position with respect to the lenses is shown in FIG. 16(*c*) with centered optics and in FIG. 16(*d*) with shifted optics. A combination of both baffle approaches is shown in FIG. 16(*e*) with centered optics and in FIG. 16(*f*) with shifted optics.
Figure 16B:
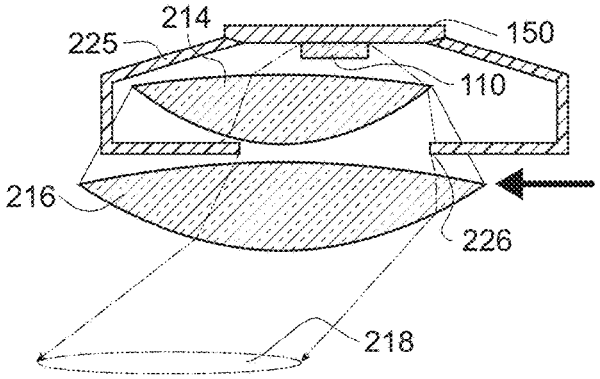
Figure 16C:
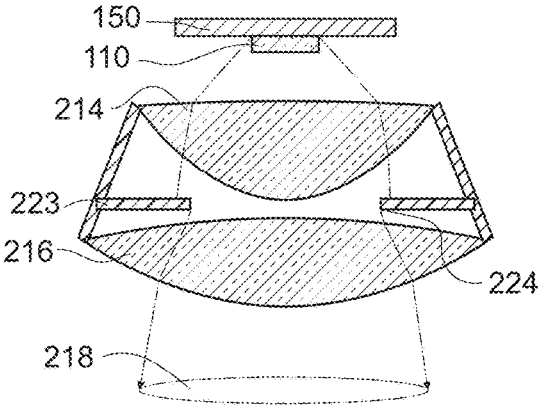
Figure 16D:
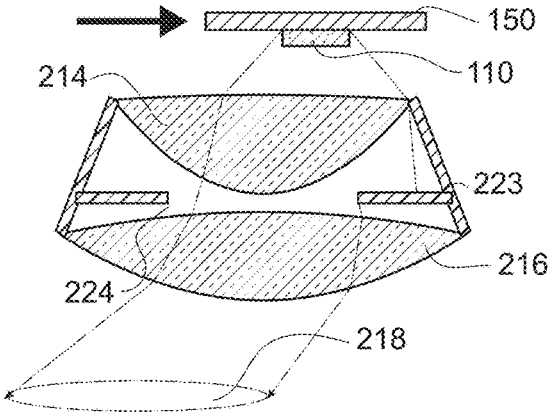
Figure 16E:
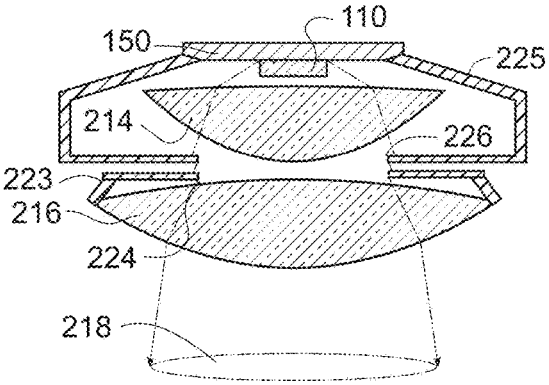
Figure 16F:
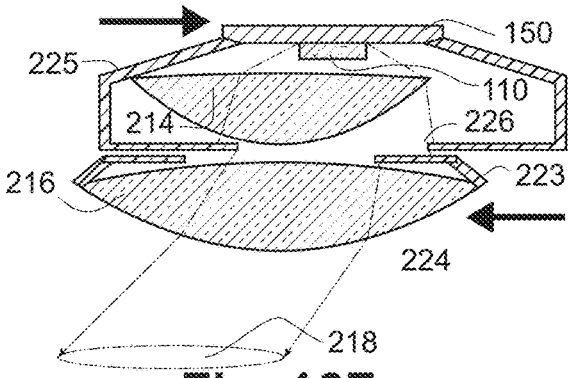

This section describes designs for directional illumination fixtures that are comprised of an emitting source and a refractive optical system that steers a beam by relative translation of the emitting source against the optical system. One embodiment is shown in FIGS. 14(*a*) to 14(*c*). The light emitting source 110 is mounted on a circuit board 150 which provides electric power and extracts waste heat. The light emitting source 110 provides light output into a wide range of angles. The optical system is comprised of one or more refractive lenses and in some embodiments mixing channels and/or one or more baffles with apertures. The design is typically optimized to produce a round, uniform beam that retains approximately the same power level and beam width as it is steered.

Many detailed aspects of the optical system designs are possible. A preferred embodiment includes two lenses aligned with a common optical axis and fixed in position relative to each other. The two lenses include a first lens 214 with optical axis 204 and one face in close proximity (distance small relative to the clear aperture of the first lens) to the light emitting source 110, and a second lens 216 with optical axis 206. The two lenses 214, 216 are positionally fixed together so that optical axis 204 is aligned with optical axis 206. The light emitting source may be placed along the optical axis of the lenses to produce a beam along that axis, or translated in-plane (orthogonal to the optical axis) relative to the lenses to produce a steered beam. The relative positioning between the lenses and the light emitting source 110 determines the aimed direction of the emitted beam of light 218. It is preferable, but not required, that the first lens 214 be of higher optical power than the second lens 216. Further, it is beneficial, but not required, that the second lens 216 have a diameter equal to or larger than the first lens 214, in order to accommodate translation of the steered beam as it transits the optical system. The lenses are designed and configured so that the effective focal plane of the two lenses together is located approximately at the plane of the light emitting source. In order to keep the optical system as small as possible, it may be desired to utilize lenses with a low focal ratio (focal distance divided by aperture), and place the two lenses close to each other with a small gap (with the gap dimensions limited by manufacturing tolerances).

The relative positioning between the lenses and the light emitting source can be controlled by motion of either or both the light emitting source and the lenses. FIG. 14(*b*) depicts beam steering by translation of the light emitting source and its associated circuit board while the optical system remains fixed in position. FIG. 14(*c*) depicts beam steering by translation of the optical system while the light emitting source 110 remains fixed in position.

With proper design of the lens elements 214, 216, this configuration maintains a uniform round beam over a range of tilt angles up to 30° or more, simply by small translation of the lenses. In comparison, a conventional spotlight fixture uses a parabolic reflector surrounding a light source and requires the entire assembly to be pivoted in order to tilt the light beam. If instead the light source is held stationary and the parabolic reflector translated a small amount, the beam rapidly distorts and cannot be effectively steered.

In one preferred embodiment, shown in FIG. 15(*a*), the first lens 214 is planoconvex and the planar side is in close proximity to the light emitting source, while the second lens 216 is double-convex. An example of this embodiment uses glass or polymer material of refractive index approximately 1.5, with the first and second lenses both having a focal ratio in the range 0.5 to 1.5. Additionally, both lenses are preferred to be aspheric, with surface profiles of either prolate ellipsoid, parabolic, or hyperbolic, or stated equivalently, possessing a conic constant less than 0. In some preferred embodiments, the diameter of the lenses is between 20 mm to 200 mm, the width of the light beam is 5 degrees to 60 degrees measured at full-width of half-maximum, and the beam can be adjusted to tilt angles between 0° and 45°.

In another embodiment, shown in FIG. 15(*b*), both the first lens 214 and second lens 216 are planoconvex with their convex faces facing each other. FIG. 15(*c*) depicts another embodiment, where the first lens 214 and second lens 216 are both planoconvex with their planar faces orientated towards each other. In another embodiment, shown in FIG. 15(*d*), both the first lens 214 and second lens 216 are double-convex.

In some embodiments, shown in FIGS. 16(*a*) and 16(*b*), a baffle 225 with an aperture 226 is present to block undesirable light transmission. The aperture is perpendicular to the optical axes 204 and 206 of the lenses and inserted between the first and second lens. The aperture 226 is fixed and remains centered relative to the light emitting source as shown in FIGS. 16(*a*) and 16(*b*). In another embodiment, a baffle 223 with an aperture 224 is centered and fixed about the optical axis of the lenses with relative motion to the light emitting source 110 as shown in FIGS. 16(*c*) and 16(*d*). In another embodiment, depicted in FIGS. 16(*e*) and 16(*f*), both baffles 223 and 225 are present and an effective aperture is created by their overlap.

Figure 17A:
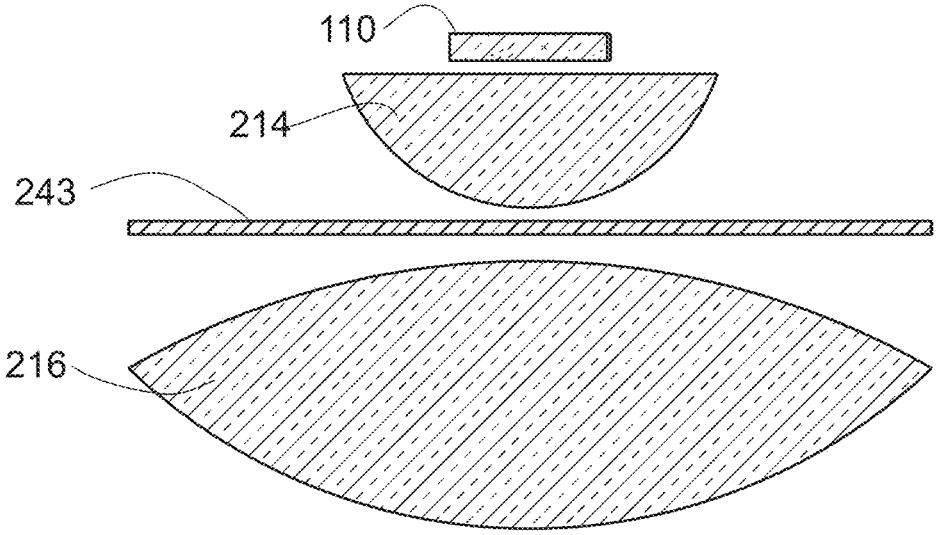
FIGS. 17(*a*) and 17(*b*) shows an elliptical aperture placed between the two lenses of the two-lens optic to occlude undesirable light, shown in cross-section in FIG. 17(*a*) and perspective in FIG. 17(*b*)
Figure 17B:
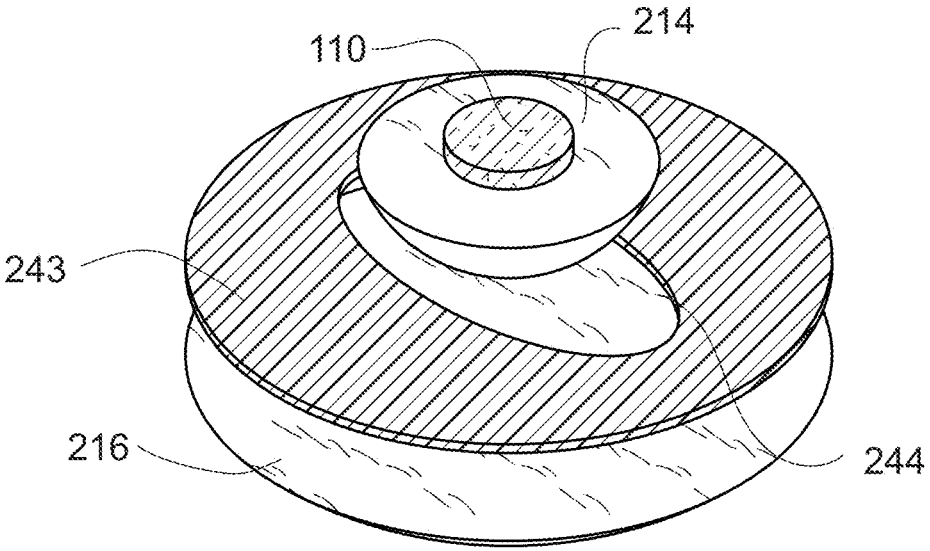

Apertures 223 and 225 are preferably, but not necessarily, circular. In another embodiment, depicted in FIGS. 17(*a*) and 17(*b*), a baffle 243 with an elliptical aperture 244 is used. The major axis of the elliptical aperture 244 is oriented parallel to the line connecting the center of the light emitting source to the optical axis.

Figure 18A:
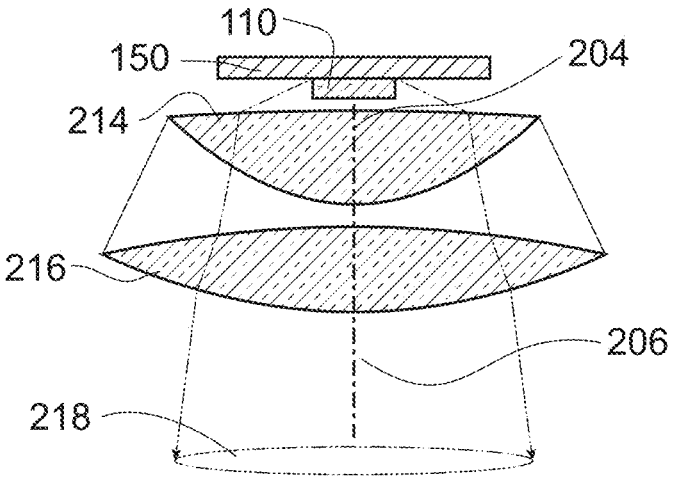
FIGS. 18(*a*) and 18(*b*) show an adjustable lighting fixture in which the optical axis of the two lenses are shifted by different amounts as the optics are displaced laterally.
Figure 18B:
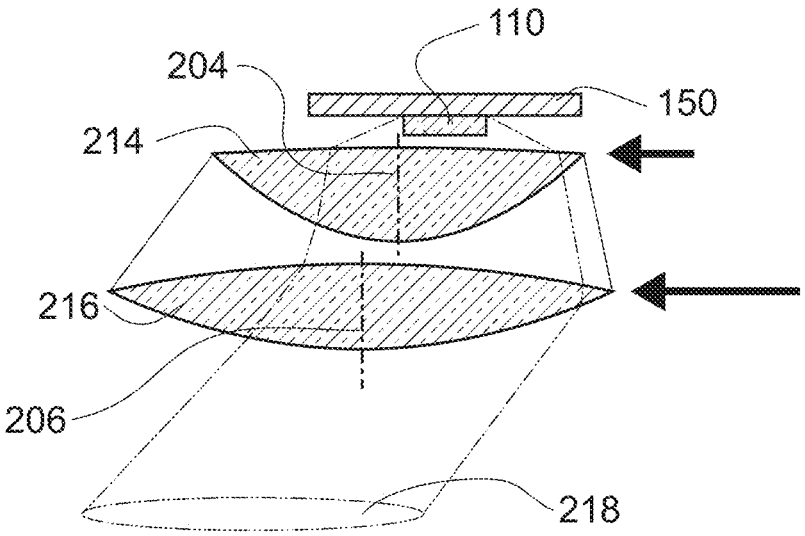

In another embodiment, shown in FIGS. 18(*a*) and 18(*b*), the optical axes 204 and 206 are not held in fixed alignment but instead vary in position as the lenses are moved relative to the light emitter 110. The optical axes are aligned when the lenses are centered with respect to the light emitter 110, as shown in FIG. 18(*a*). During beam steering, the first lens 214 and second lens 216 translate in the same direction but at different rates relative to the light emitter 110, so that the optical axes 204 and 206 become misaligned as the beam is steered, as shown in FIG. 18(*b*). In general, it is preferable that lens 216 translates at a faster rate than lens 214, and that the two optical axes 204 and 206 remain parallel to each other and perpendicular to the plane of the light emitter 110. A linkage system or other mechanical configuration may be employed to control the relative position of lens 214 and lens 216 as they are moved.

Figure 19A:
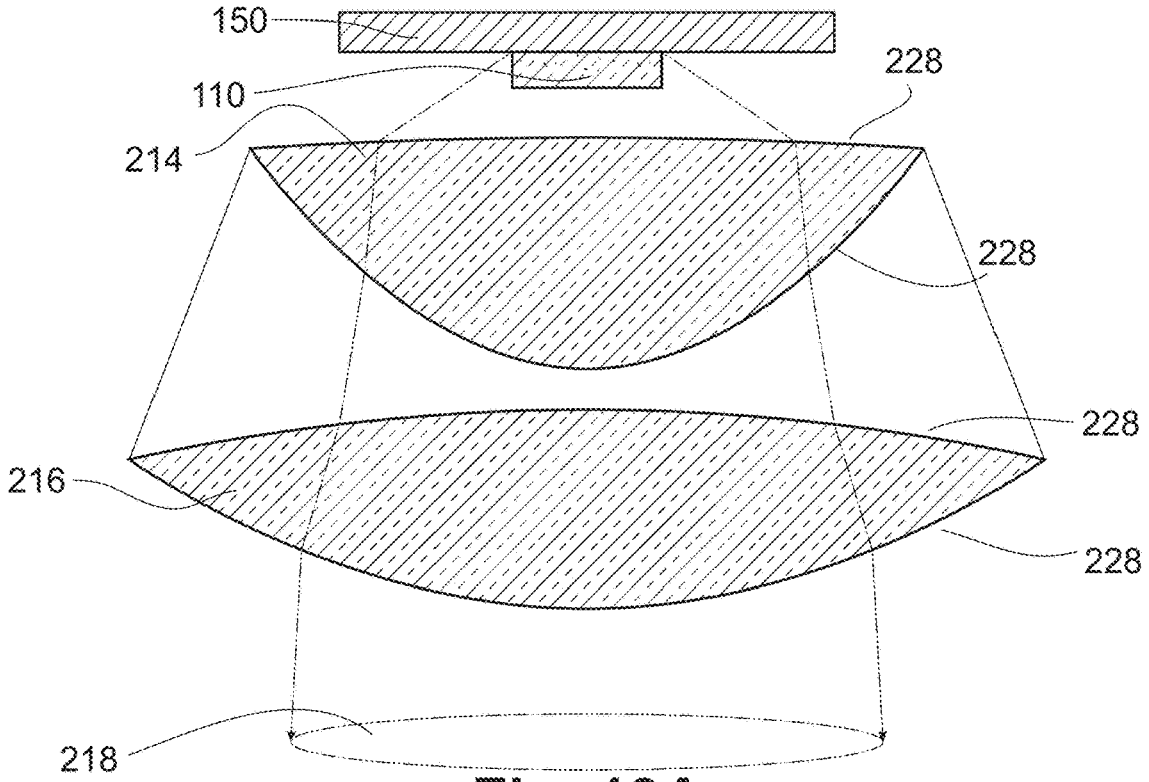
FIGS. 19(*a*) and 19(*b*) show cross-sectional views of an adjustable lighting fixture.
Figure 19B:
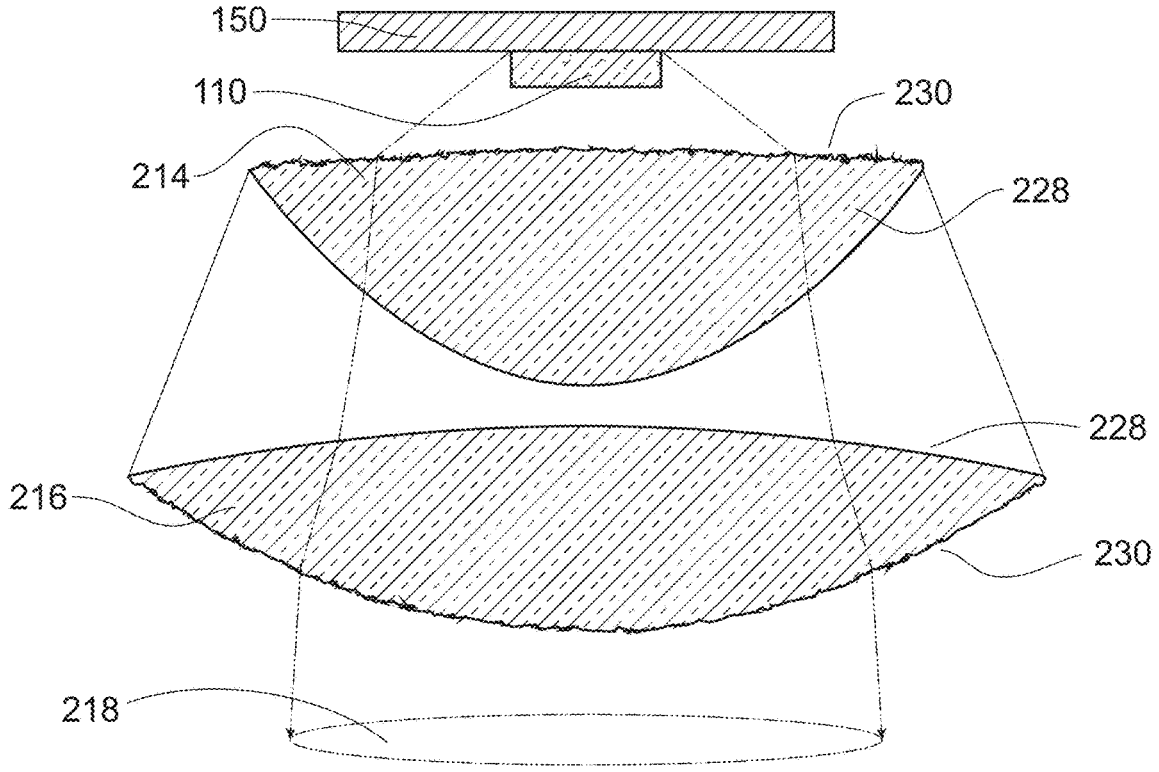
Figure 20A:
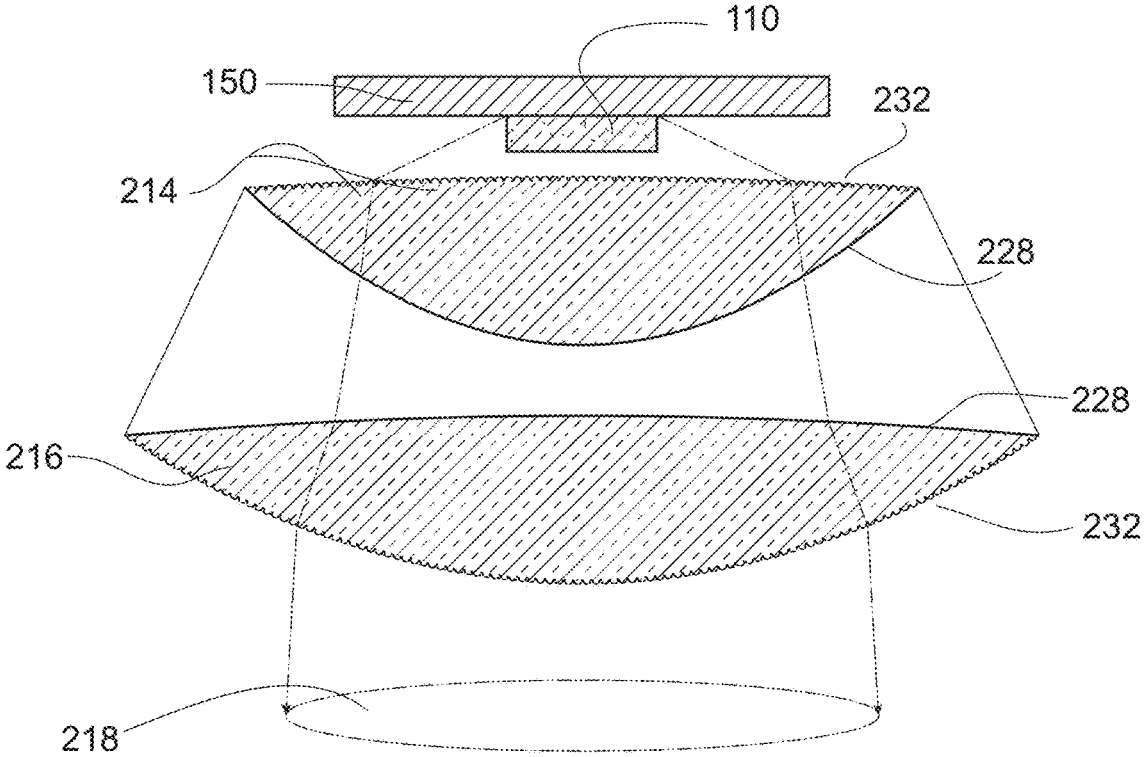
FIGS. 20(*a*) and 20(*b*) show cross-sectional views of an adjustable lighting fixture with texturing on some surfaces of the lenses.
Figure 20B:
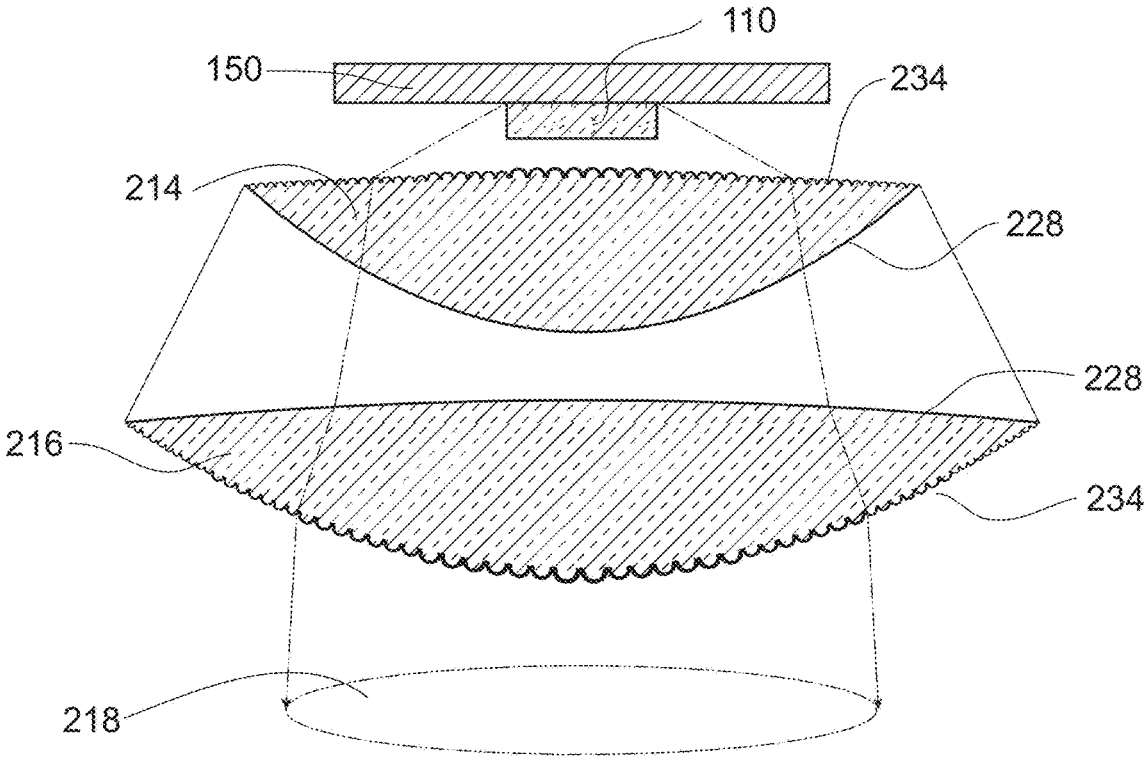
Figure 21A:
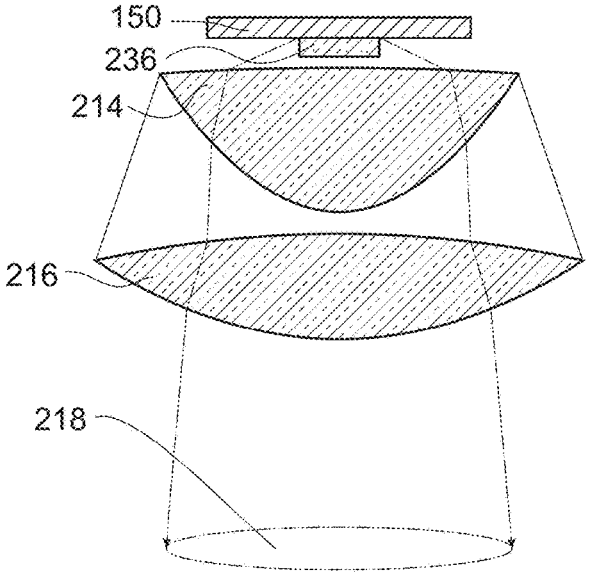
FIGS. 21(*a*) to 21(*d*) show cross-sectional views of adjustable lighting fixtures.
Figure 21B:
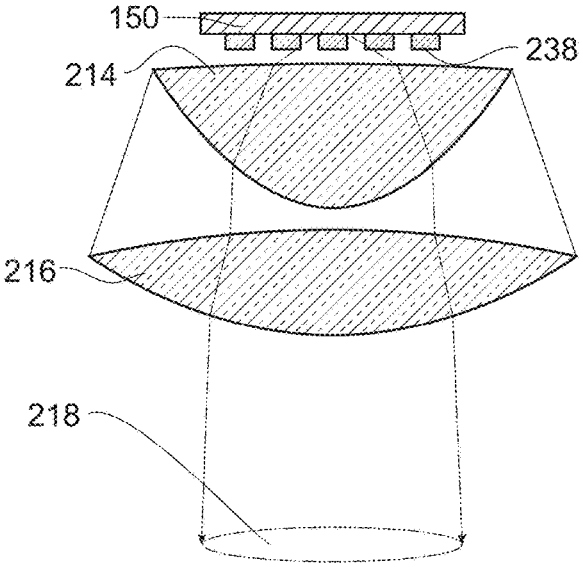
Figure 21C:
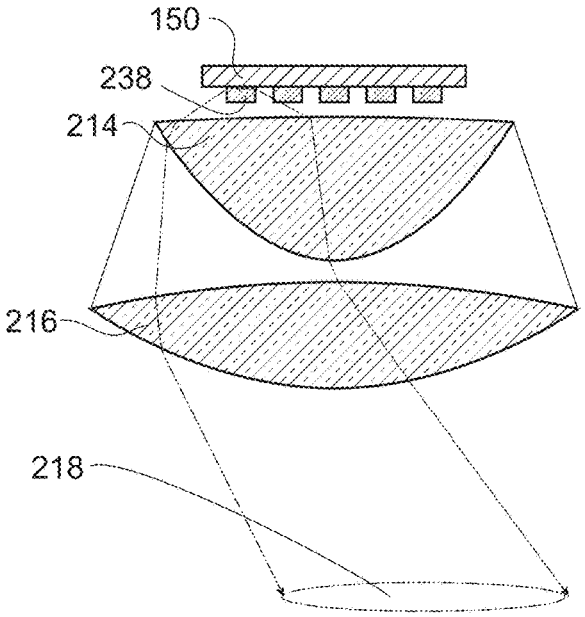
Figure 21D:
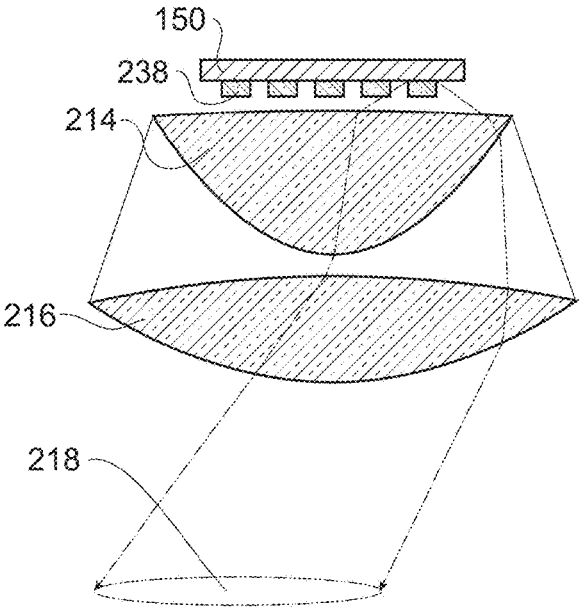

In the embodiments described thus far, all four faces of the two lenses are optically smooth surfaces 228, as indicated in FIG. 19(*a*). In other embodiments, one or more of the faces of the lenses is textured to diffuse the emitted beam. In one such embodiment, depicted in FIG. 19(*b*), the lens has randomly textured surfaces 230. In another embodiment, the texturing is an array of geometric features. Uniform geometric texturing 232 may be used, so that the texturing pattern is consistent across the surface of the lens, as shown in FIG. 20(*a*). Or geometric texturing with a spatial dependence 234 may be used, as shown in FIG. 20(*b*). Such texturing 234 may have a spatial dependence designed to alter the beam in the course of steering, for example to counteract distortion in the projected beam from aberration within the optical system, or to broaden, reduce, or otherwise alter the desired beam profile with steering.

In the above described embodiments, the light emitting source is a single light emitting source 236, as in FIG. 21(*a*). In other embodiments, the light emitting source includes multiple individually electrically addressable light emitting sources 238, all near or within the focal plane of the lens system, as depicted in FIGS. 21(*b*), 21(*c*), and 21(*d*). The individual light emitting elements 238 may be powered in unison for a broad beam or as individual elements for a narrow beam. Steering of the projected beam is accomplished by a combination of appropriate addressing of emitters and mechanical translation of the optic or light emitting source.

Figure 22A:
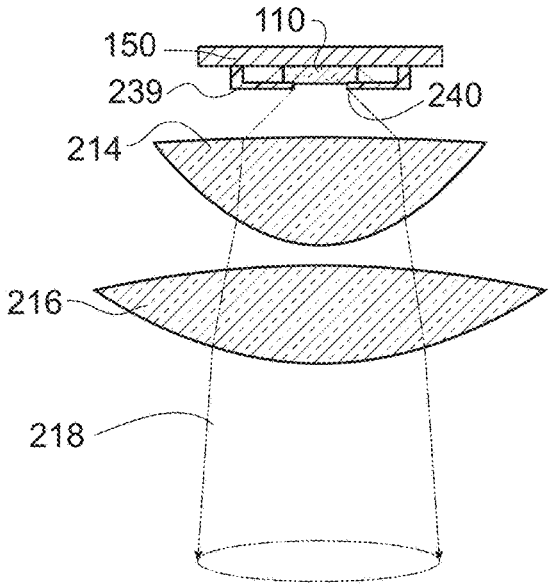
FIG. 22(*a*) shows a cross-sectional view of an adjustable lighting fixture with an iris placed directly adjacent to the light emitting source.
Figure 22B:
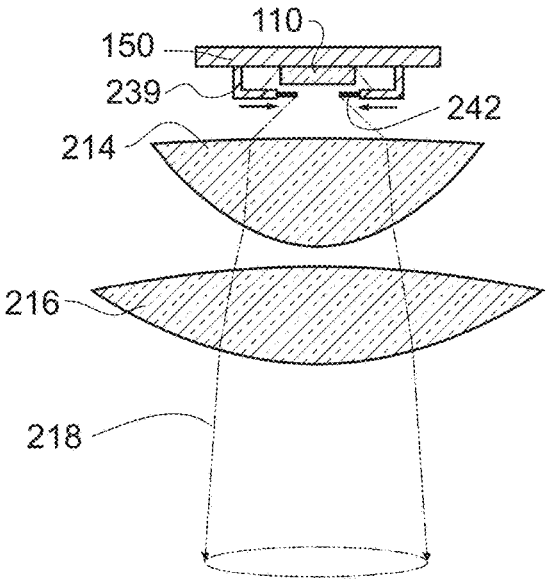
Figure 22C:
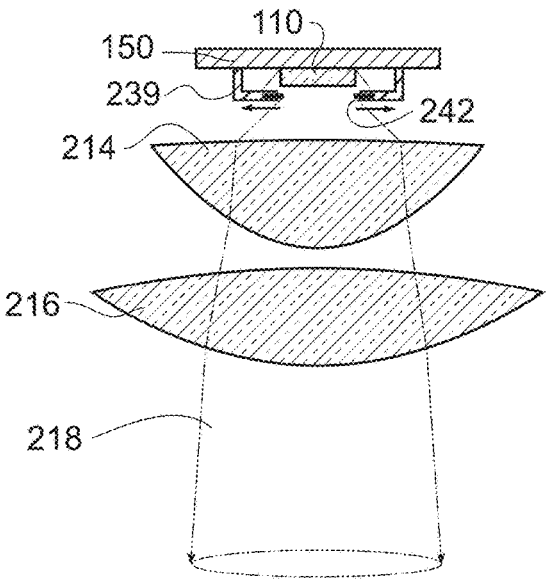

In the above described embodiments, the light emitting source has no elements between it and the first lens. In another embodiment, shown in FIG. 22(*a*), a baffle 239 with an iris 240 is positioned between the light emitting source 110 and the first lens 214 to reduce its effective size, change its effective shape, or alter its effective angular emission profile. In another embodiment shown in FIG. 22(*b*) and FIG. 22(*c*), an adjustable iris 242 is positioned in the baffle 239 between the light emitting source 110 and the first lens 214, enabling dynamic control over beam size or shape.

Figure 23:
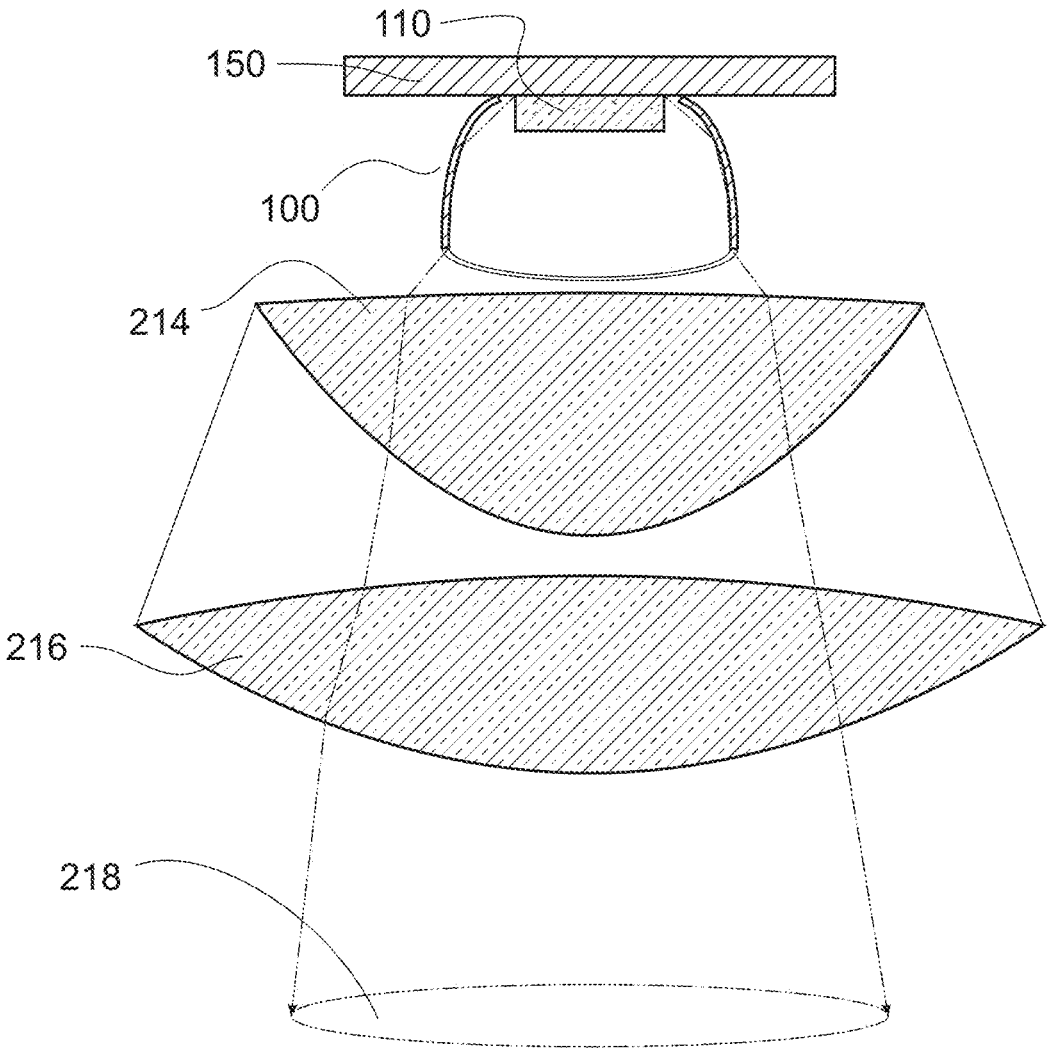
FIG. 23 shows cross-sectional view of an adjustable lighting fixture with a compound parabolic concentrator mixing channel affixed to the light emitting source.

In another embodiment, shown in FIG. 23, a mixing channel 100 is used in conjunction with the light emitter 110, to mix the emitted light before it reaches the first lens 214. In some embodiments the mixing channel 100 is fixed to the light emitter 110 and does not translate with the moving optics 214 and 216. The mixing channel 100 improves color uniformity and spatial uniformity of the emitted beam, and may take any of the forms previously described above. For example, in one preferred embodiment, the mixing channel is a collimating mixing channel, for example a mixing channel with a varying width to form a compound parabolic concentrator, as shown in FIG. 23. Such a collimating mixing channel reduces the angular variation of the light impinging on the first lens 214, for example providing an angular distribution that is entirely contained within a cone of width 120 degrees. The narrow angular distribution of light impinging on the first lens 214 allows for optical designs with improved overall performance. Other beam conditioning optics may be used in place of the mixing channel 100 shown in order to achieve similar improvements in beam uniformity and optical performance. These other beam conditioning optics include lenses or light mixing channels of various designs, in all cases fixed to the light emitter 110.

In one embodiment, the lenses 214 and 216 are formed from a single transparent material such as polymethyl methacrylate (PMMA), polycarbonate (PC), or glass. In another embodiment, the lenses may be formed from multiple materials with different Abbe numbers as in an achromatic lens.

Figure 24A:
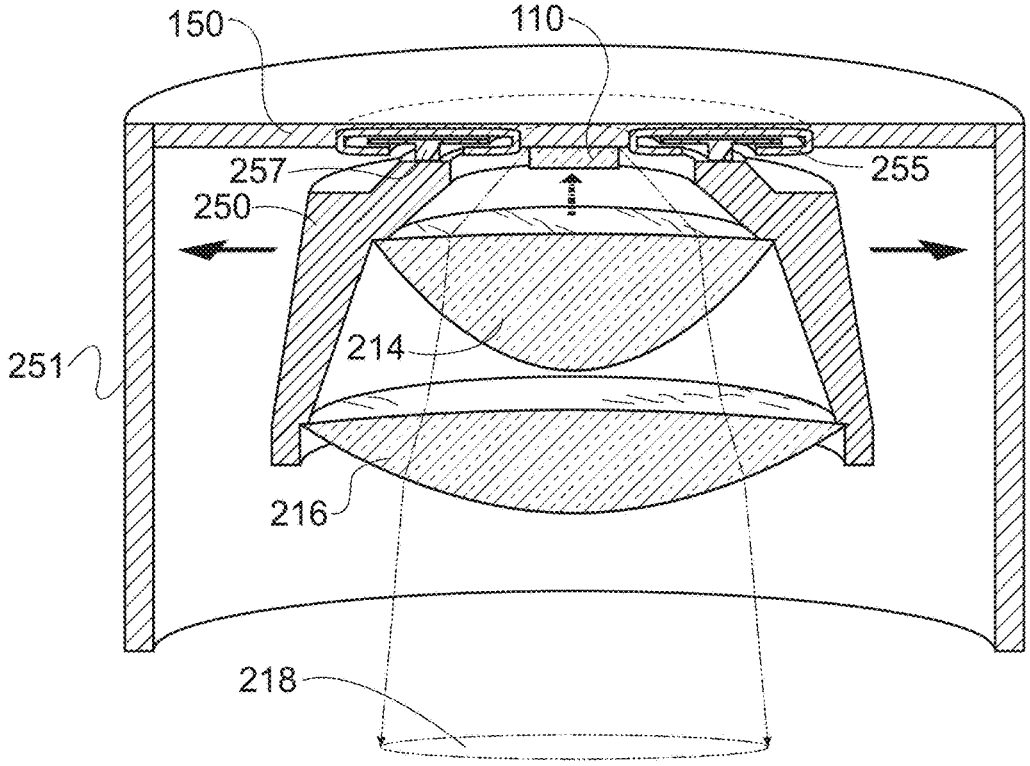
FIGS. 24(*a*) and 24(*b*) show beam steering mechanisms.
Figure 24B:
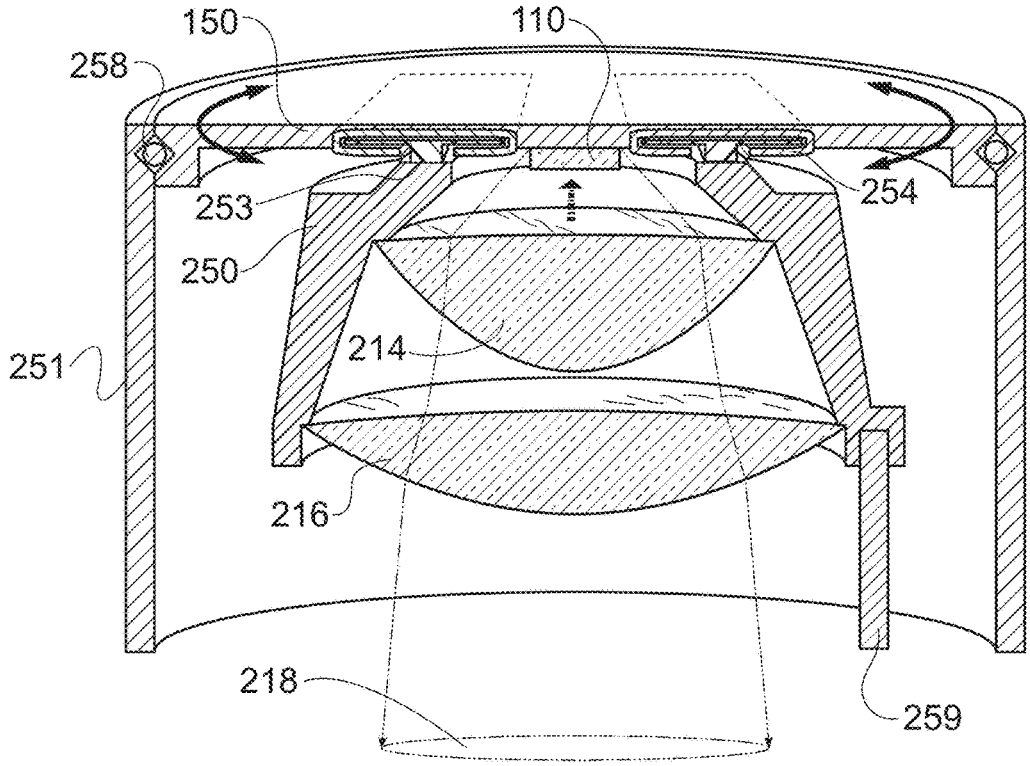

In many of the embodiments described herein, some provision for adjusting the relative position between the light emitting source and the lenses is desirable. Two preferred, alternative methods are depicted in FIGS. 24(*a*) and 24(*b*). In both examples, the lenses 214 and 216 are mounted in a barrel-type enclosure 250 that can slide relative to the housing 251, which is attached to light source 110. The design depicted in FIG. 24(*a*) permits two-dimensional Cartesian translation of either the light emitting source 110 or the lenses 214 and 216 in the enclosure 250. In this example, the enclosure 250 features tabs 257 that fit within an annular slot 255 in the housing 251, allowing the enclosure 250 to be translated in two dimensions while remaining attached to the housing 251.

In the design depicted in FIG. 24(*b*), the enclosure 250 (and enclosed lenses 214 and 216) are translated in one linear direction in a range between a centered position that aligns the optical axes of lenses 214 and 216 with the center of the light emitter 110, and a position at the perimeter of the steering range. This linear motion can be enabled, for example, by a mechanical design in which a feature on the enclosure 250 travels within a slot in the housing 251. In the example of FIG. 24(*b*), tabs 253 on enclosure 250 slide linearly within slot 254 in housing 251. The linear motion controls steering of the light beam in the "tilt" axis. The design of FIG. 24(*b*) further allows rotational movement of the optical system and the housing 251 about the center of the light emitting source 110. In the example of FIG. 24(*b*), this rotation is facilitated by interface 258, which may be a ball bearing, bushing, or other sliding interface, and the user controls the rotation by moving user interface rod 259, which is attached to enclosure 250. In a variant of this design (not shown), the housing 251 is fixed relative to the light emitting source, and instead the entire fixture is rotated. Rotation of either the housing 251 or the entire fixture controls steering of the light beam in the "pan" axis.

Figure 25:
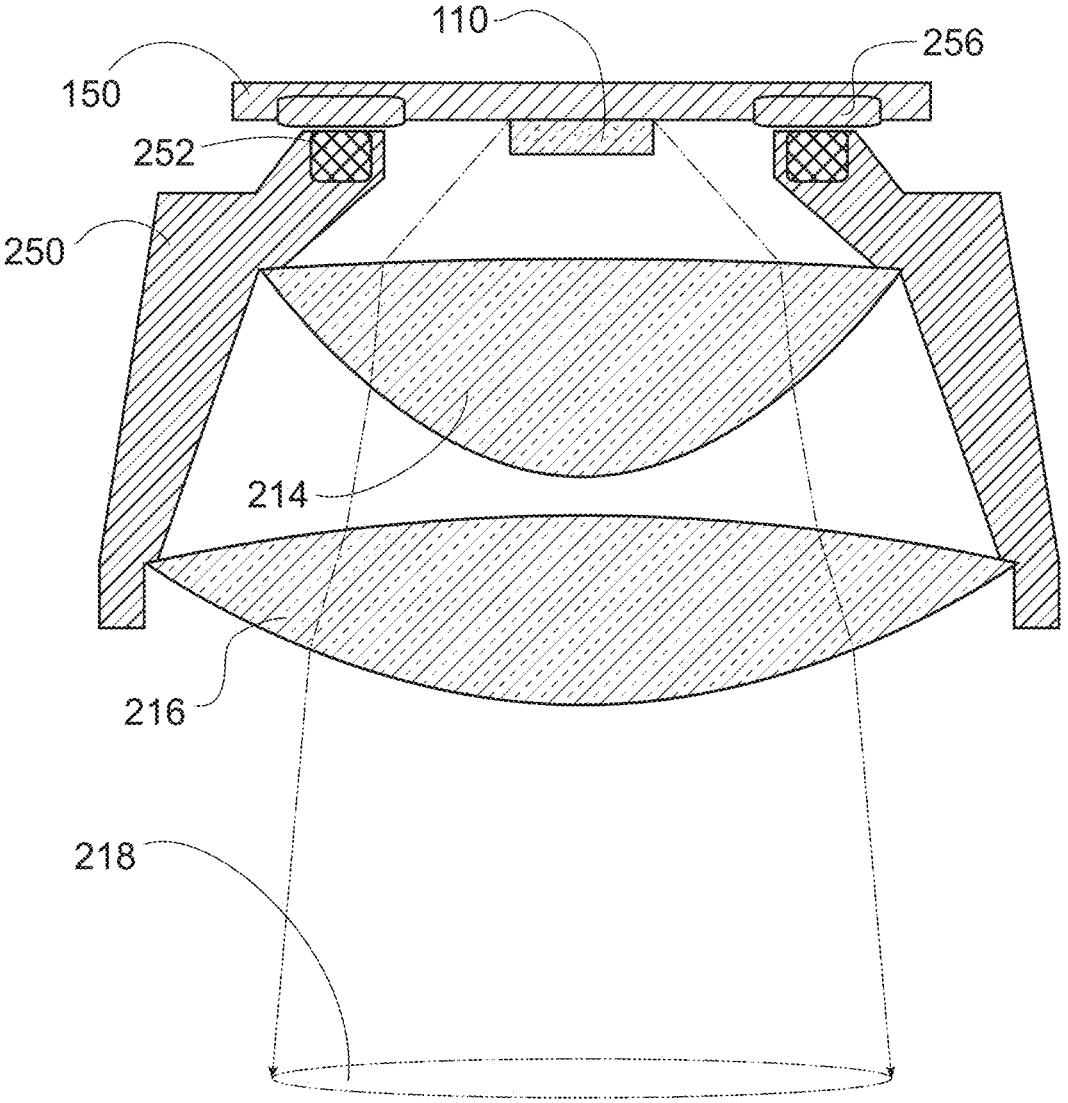
FIG. 25 shows a cross-sectional view of an adjustable lighting fixture in which the two-lens optic is attached using magnets.

FIG. 25 shows a variant of the mechanism design in FIG. 24(*a*). In FIG. 25, the lenses 214 and 216 are retained against the plane containing the light emitting source 110 by one or more magnets 252 embedded within the enclosure 250 that holds the lenses 214 and 216. A plate 256 of ferromagnetic material is attached to the plane of the light emitting source 100. The magnets 252 hold the lens enclosure 250 to the plate 256, providing a retaining force to keep the lenses in a given location while also allowing easy translation of the lens enclosure 250 by sliding the magnets 252 across the plate 256. The enclosure 250 containing the lenses may be a user-replaceable part of the lighting fixture, so that a given enclosure 250 with a certain set of lenses can be easily switched with alternative enclosures with alternative lens elements to vary the beam properties. These various alternative lens assemblies may provide alternative beam characteristics, including beam width, shape, steering range, color, or glare characteristics.

Figure 26A:
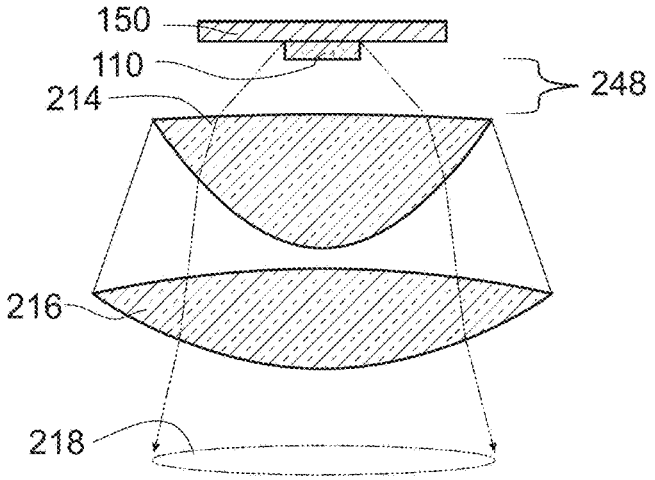
FIGS. 26(*a*) to 26(*c*) show cross-sectional views of an adjustable lighting fixture in which the distance between the light emitter and the first lens can be varied.
Figure 26B:
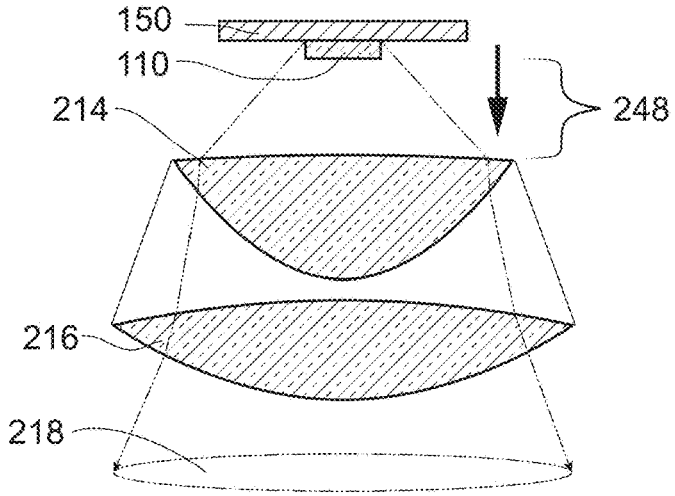
Figure 26C:
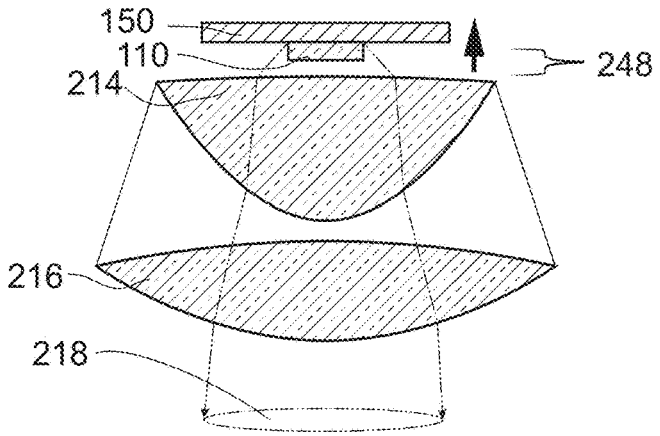

In the embodiments shown in FIGS. 26(*a*) to 26(*c*), the distance 248 along the optical axis between the light emitting source 110 and the nearest face of the adjacent lens is made adjustable, while the gap between the first lens 214 and the second lens 216 is kept fixed. The distance 248 may be varied in order to change the apparent extent of the source and consequent beam width. In other embodiments, the relative position of the first lens 214 and the second lens 216 along the optical axis 204 or 206 is also adjustable to broaden or contract the emitted beam 218.

The mechanisms of FIGS. 24(*a*), 24(*b*), 25, and 26 may be designed for manual operation, as shown, in which users adjust the position of the lenses by hand. Alternatively, they may be designed for remote or automated operation, in which users adjust the position using electronic controls. In the latter case, the motions described are produced not by a user's hand but by an arrangement of motors and mechanical gears or linkages (not shown). Such a system could further include electronic motion controllers, position sensors to provide feedback to these motion controllers, and a communication module that provides a means for positioning commands to be transmitted to the fixture.

Figure 27A:
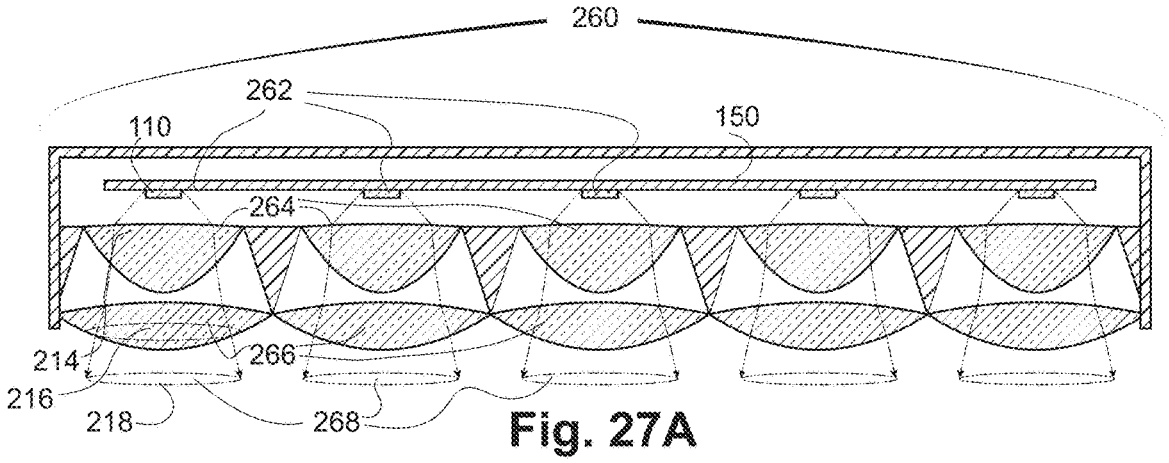
FIGS. 27(*a*) to 27(*c*) show cross-sectional views of an adjustable lighting fixture containing an array of light emitters and a corresponding array of first and second lens optics.
Figure 27B:
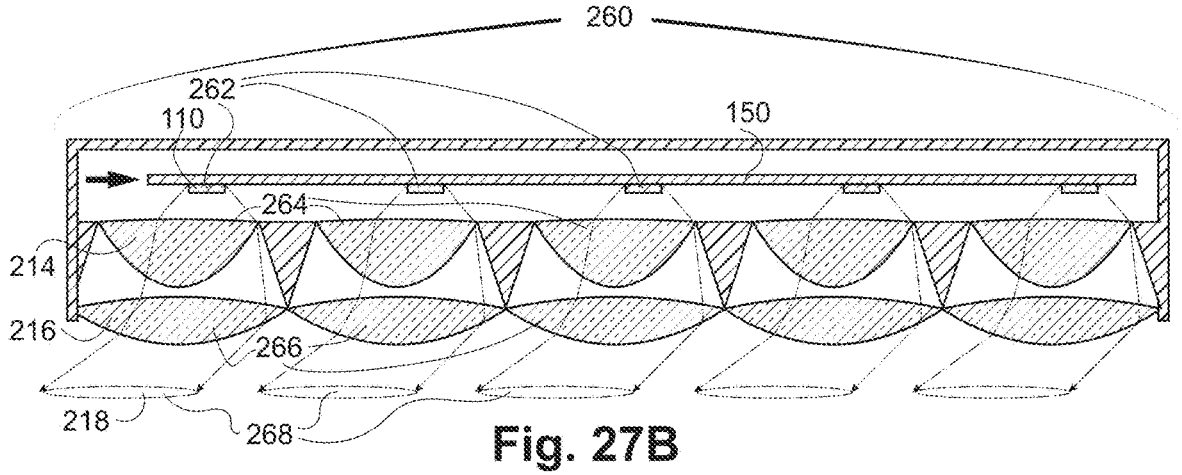
Figure 27C:
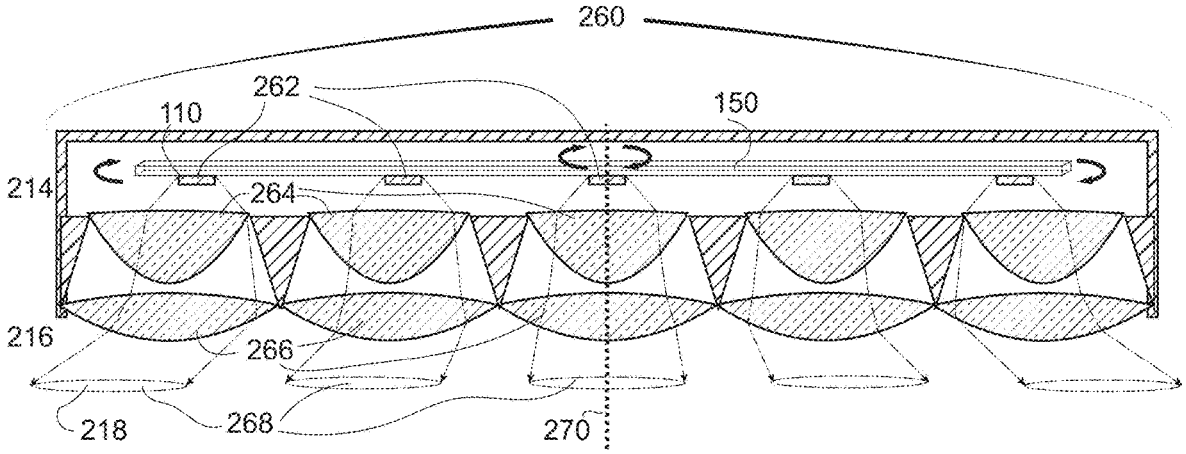

In another embodiment, shown in FIG. 27(*a*), a light fixture 260 consists of an array 262 of light emitters 110, an associated array 264 of first lenses 214, and an associated array 266 of second lenses 216. The array 262 of light emitters may optionally be produced using a common circuit board 280, and the arrays 264 and 266 may each optionally be produced as a single solid optical element. As shown in FIG. 27(*b*), the array of light sources 262 may be translated relative to the lens arrays (264 and 266), to produce a combined steered beam 268 of greater overall power than produced by a single source and associated lens pair. Further, as shown in FIG. 27(*c*), the array of light sources 262 may be rotated about a central axis 270 relative to the arrays of lenses (264 and 266), in order to steer each beam in a slightly different direction, providing a mechanism to broaden the combined beam if desired. Such an array embodiment can be combined with other embodiments described above.

These examples are not exhaustive, and other useful implementations will now, in light of the above, be evident to those skilled in the art.

Part 3: Lightfield Luminaires

This section describes facile formation of lighting fixtures with any particular desired light distribution pattern, or "lightfield." These designs are not limited to a single round beam, but can be a pattern of beams, an asymmetric shape, or any other desired intensity distribution in angular space.

Figure 28:
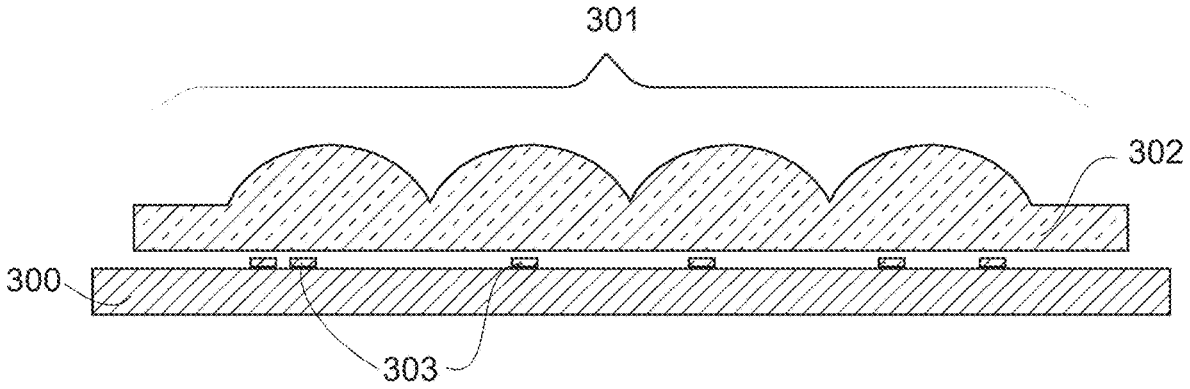
FIG. 28 provides a cross-section view of a direct lightfield luminaire.

FIG. 28 shows an embodiment of such a configurable luminaire, which will be referred to as the "direct lightfield luminaire." A circuit board 300 is approximately at the focal plane of an array of lenses 301. In a preferred embodiment the circuit board 300 is a printed circuit board and the array of lenses 301 is comprised of refractive lenses 302. The circuit board 300 is populated with light emitters 303, preferably light emitting diodes or lasers. A light emitter 303 is associated with a given lens 302 in the array of lenses 301 that at least partially collimates light emitted by the light source 303, resulting in a beam of light emitted from the luminaire that is referred to as a beamlet 304.

Figure 29:
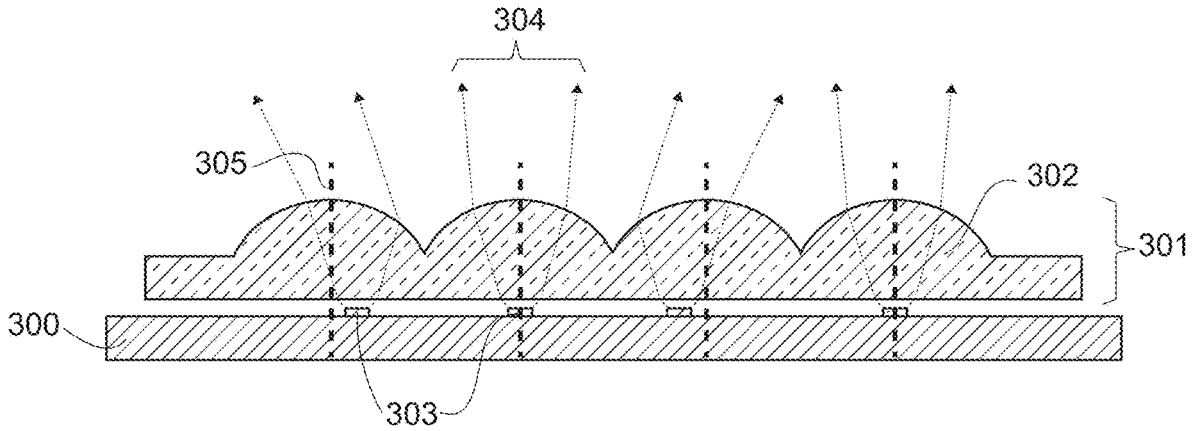
FIG. 29 provides an example of beamlet steering by the position of light sources relative to their respective lenses.

FIG. 29 shows that the direction that the beamlet 304 from a particular light source 303 exits the luminaire depends upon its position within the focal plane of its associated lens 302. A light source 303 located on the optical axis 305 of its associated lens 302 will have a beamlet 304 that is emitted parallel to the optical axis 305, while a light source offset from the optical axis 305 of its associated lens 302 will have a beamlet 304 that is steered to a corresponding angle.

Figure 30:
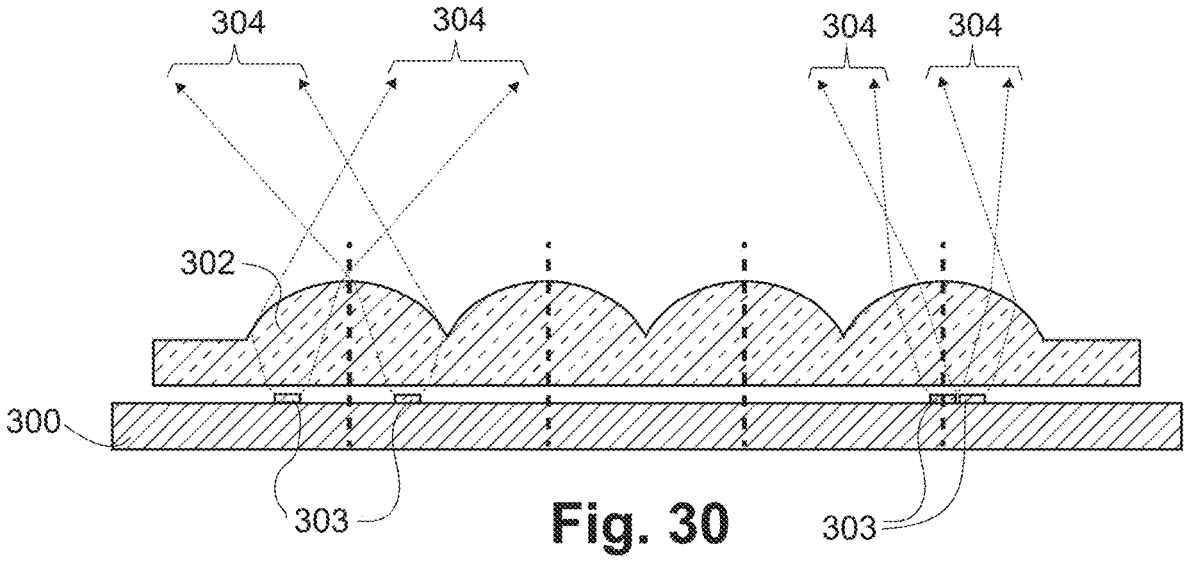
FIG. 30 provides examples of aggregate beams that can be formed with multiple light sources per lens.

FIG. 30 shows how more than one light source 303 may be associated with a given lens 302, resulting in multiple beamlets 304 emitted from the lens 302. For multiple beamlets 304 emitted from a given lens 302, the beamlets 304 may appear separated as they are emitted from the luminaire or may appear to overlap and form more complex illuminated shapes, depending on the light emission pattern of the associated light sources 303, the distance between the associated light sources 303, and the optical formula of the lens 302.

Figure 31:
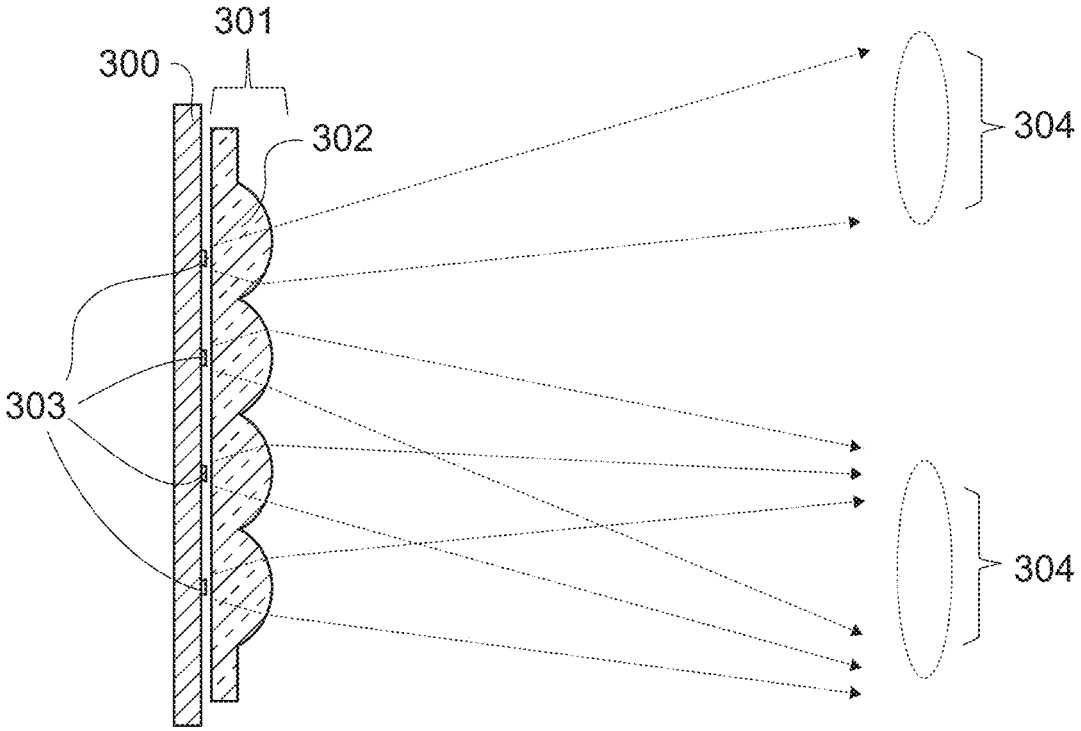
FIG. 31 provides an example of varying intensity by varying the number of beamlets pointing in a given direction.

Therefore, the total lightfield of the luminaire is the aggregate of all the steered beamlets 304 produced as light from each light source 303 transits the array of lenses 301. The pattern of beamlets 304 emitted by each of the lenses 302 in the array of lenses 301 need not be identical; indeed, variations in brightness across the lightfield may be produced by varying the number of beamlets 304 that are emitted in a given direction, as shown in FIG. 31.

Customized Circuit Boards

Figure 32:
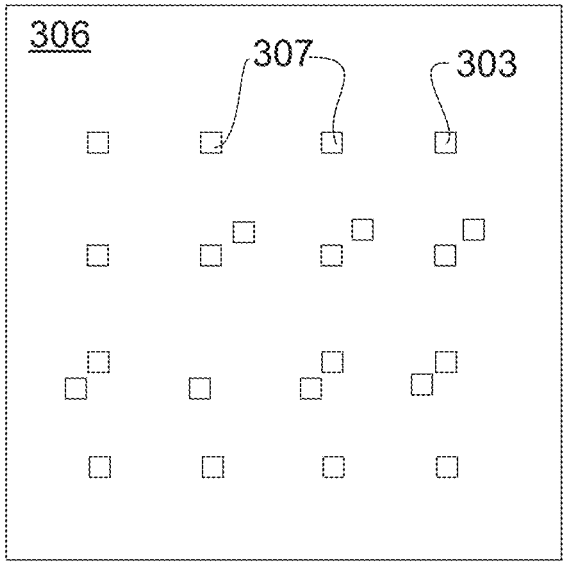
FIG. 32 provides an example of a custom circuit board with specific positions fabricated for incorporating light sources.

FIG. 32 shows how circuit board 300 may be implemented as a customized circuit board 306 provided with many positions 307 that are populated by light sources 303. A desired lightfield may be constructed by choosing where on the customized circuit board 306 the positions 307 are fabricated. This provides a simple and low-cost mechanism to customize complex lightfields without requiring customized optics and multiple luminaires, but does require a customized circuit board 306 to be designed for every desired lightfield.

Pre Formed Circuit Boards

Figure 33:
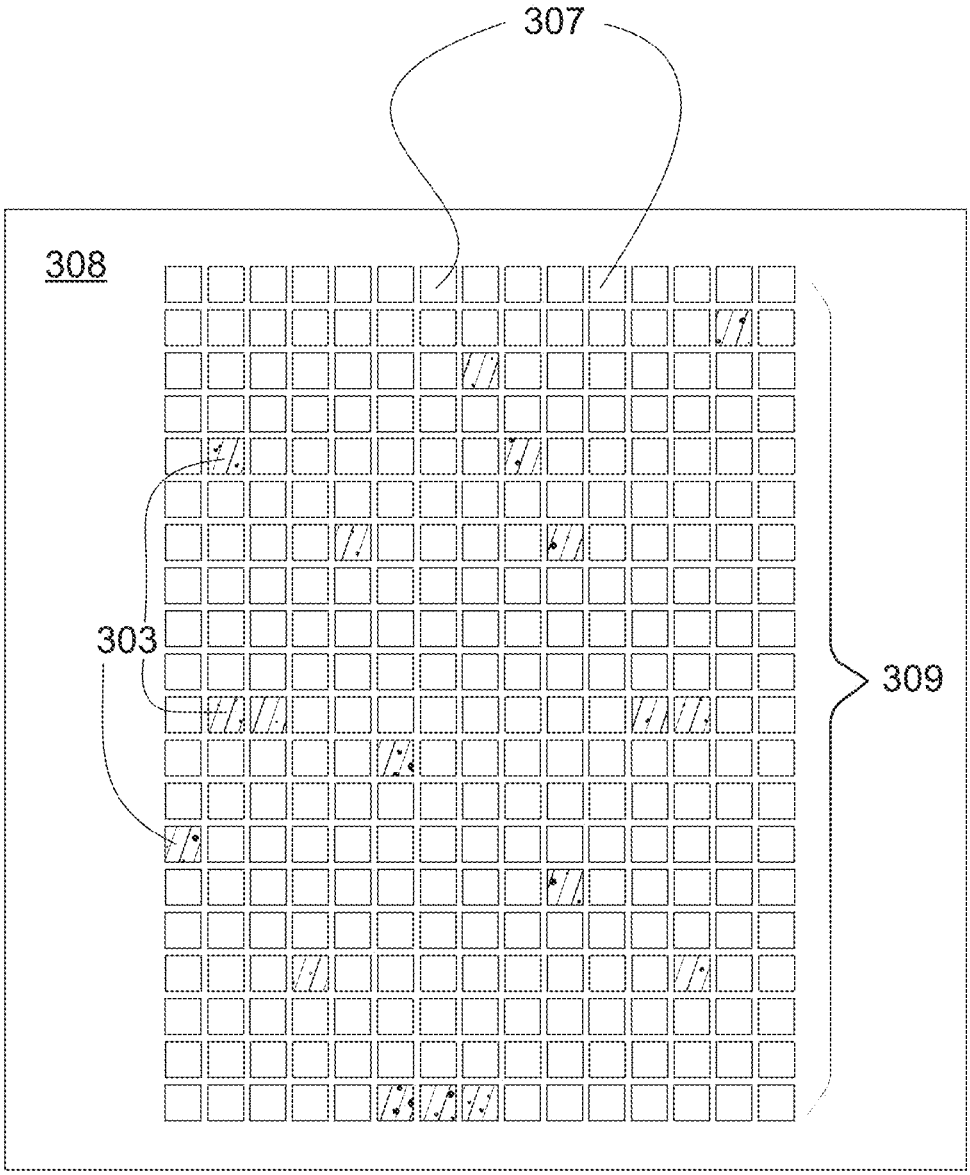
FIG. 33 provides an example of a pre-formed circuit board with a dense array of positions that may be populated with light sources.

FIG. 33 shows a potentially lower cost approach where circuit board may be implemented as a pre-formed circuit board 308. Pre-formed circuit board 308 is fabricated with positions 307 arranged in a discrete, dense array of positions 309, where any number of the individual positions 307 may be selectively populated by light sources 303, for example during a pick-and-place operation. The array of positions 309 is within the focal plane of a particular lens 302. A similar array of positions is present on the circuit board for each lens 302 in the array of lenses 301. The arrangements of positions 307 within the array of positions 309 may optionally be varied for different lenses 302, in order to provide finer resolution in design of the total output light pattern.

Figure 34:
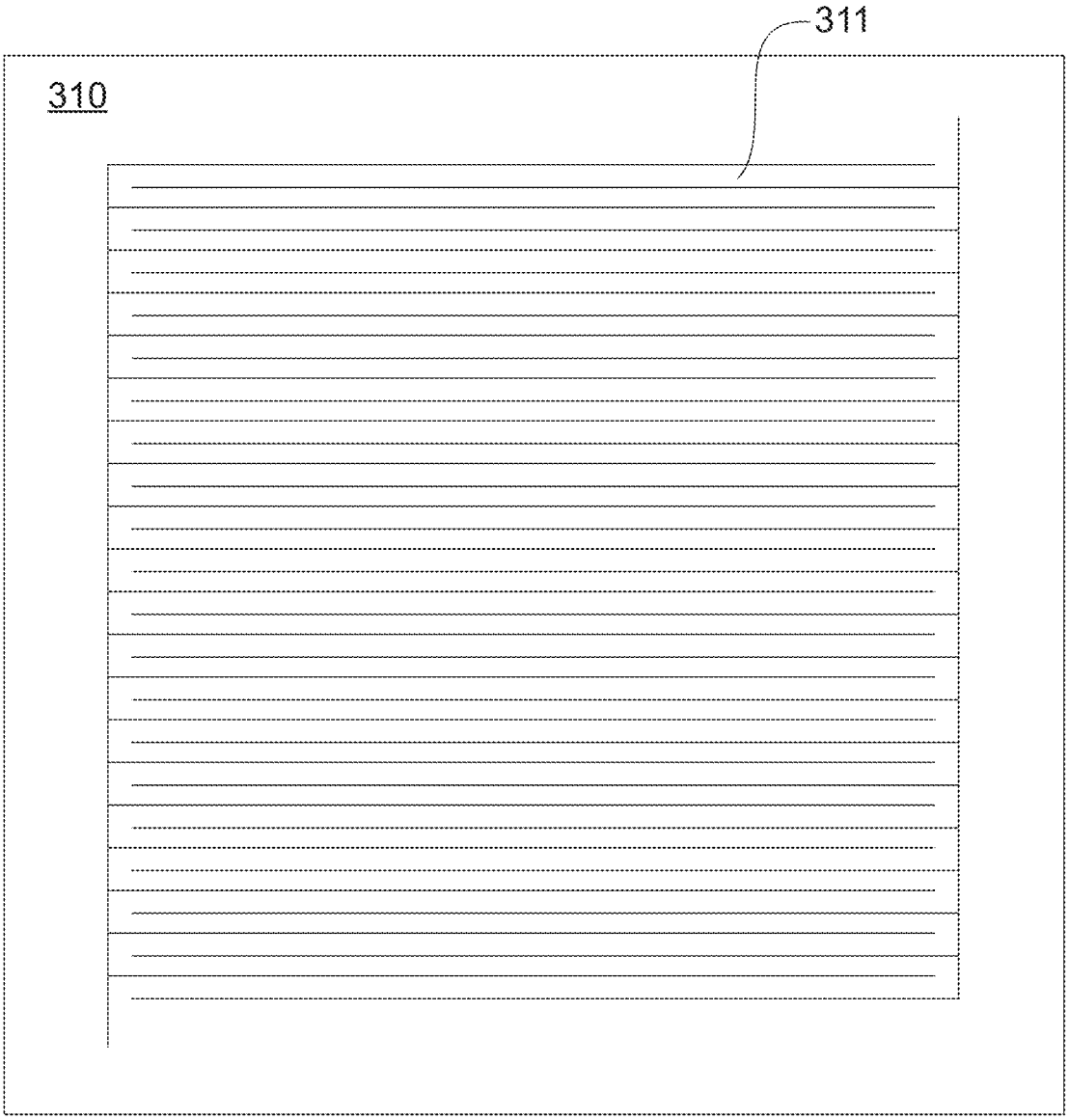
FIG. 34 provides an example of a pre-formed continuous circuit board, with a continuous network of electrodes available for light source attachment.

FIG. 34 shows an example of circuit board 300 implemented as a pre-formed continuous circuit board 310 layout in which electrodes 311 are provided continuously. This allows the position of the light source 303 to be varied continuously along the electrodes 311. The continuous electrodes 311 may be formed in straight lines (as shown), a spiral, or other shapes.

Pre-formed continuous circuit boards 310 allow a wide variety of lightfields to be produced with a given circuit board design, thus potentially lowering the design and fabrication cost of the direct lightfield luminaire.

Varying Lenses and Light Emitters

Additional flexibility and capability to generate desired lightfields may be gained by different configurations for the lenses 302 and light sources 303.

Figure 35:
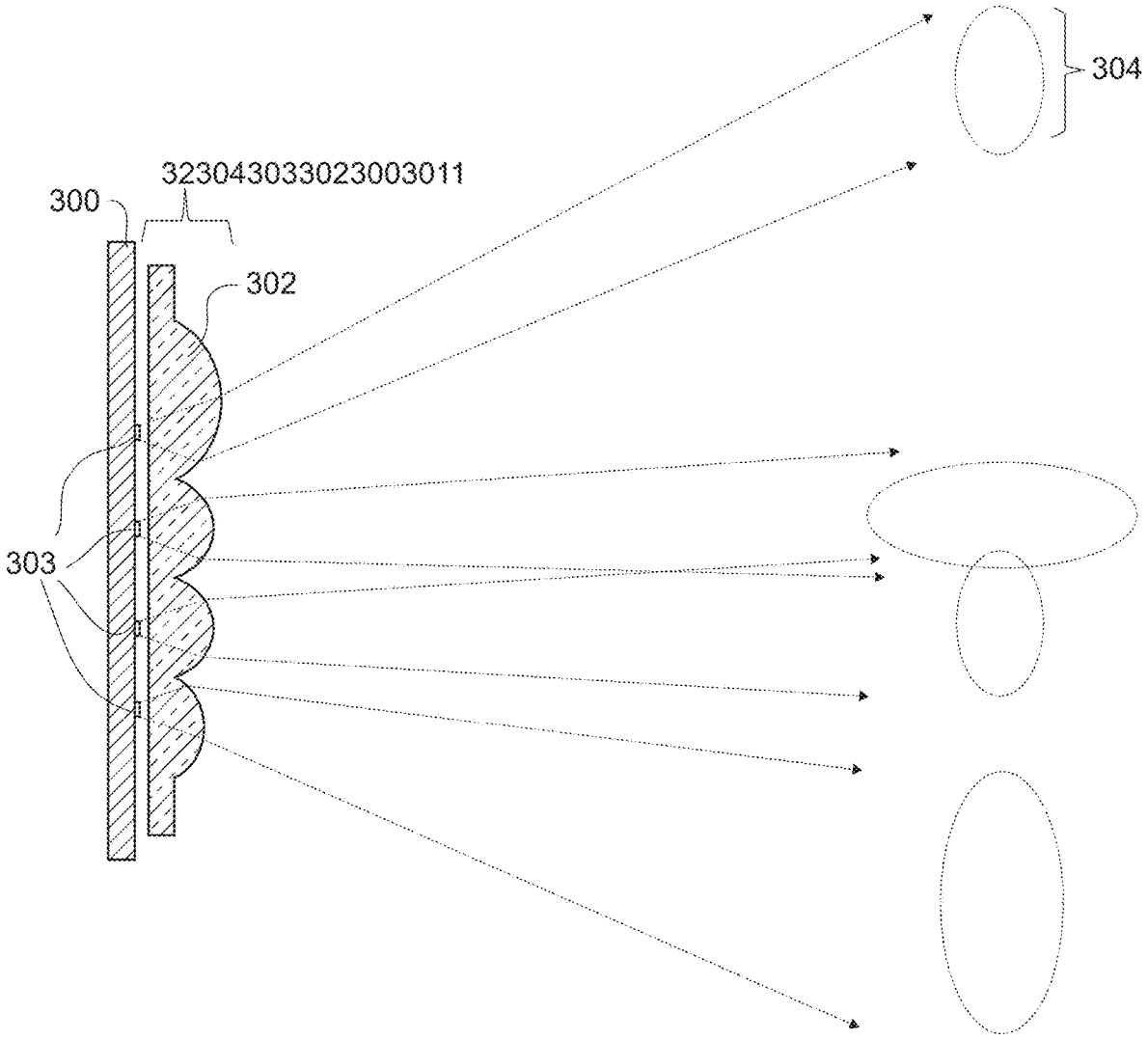
FIG. 35 provides an example of varying the size and optical formula of lenses to create different beamlet shapes.

In FIG. 35, the lens array 321 is fabricated so that different lens elements 302 may be of different size and optical formula. As a result, the beamlets 304 produced by each lens element 302 may be of different shape or width, even if identical light emitters 303 are used in each lens element 302. A non-uniform lens array therefore provides greater flexibility to tailor the lightfield that is produced.

Figure 36:
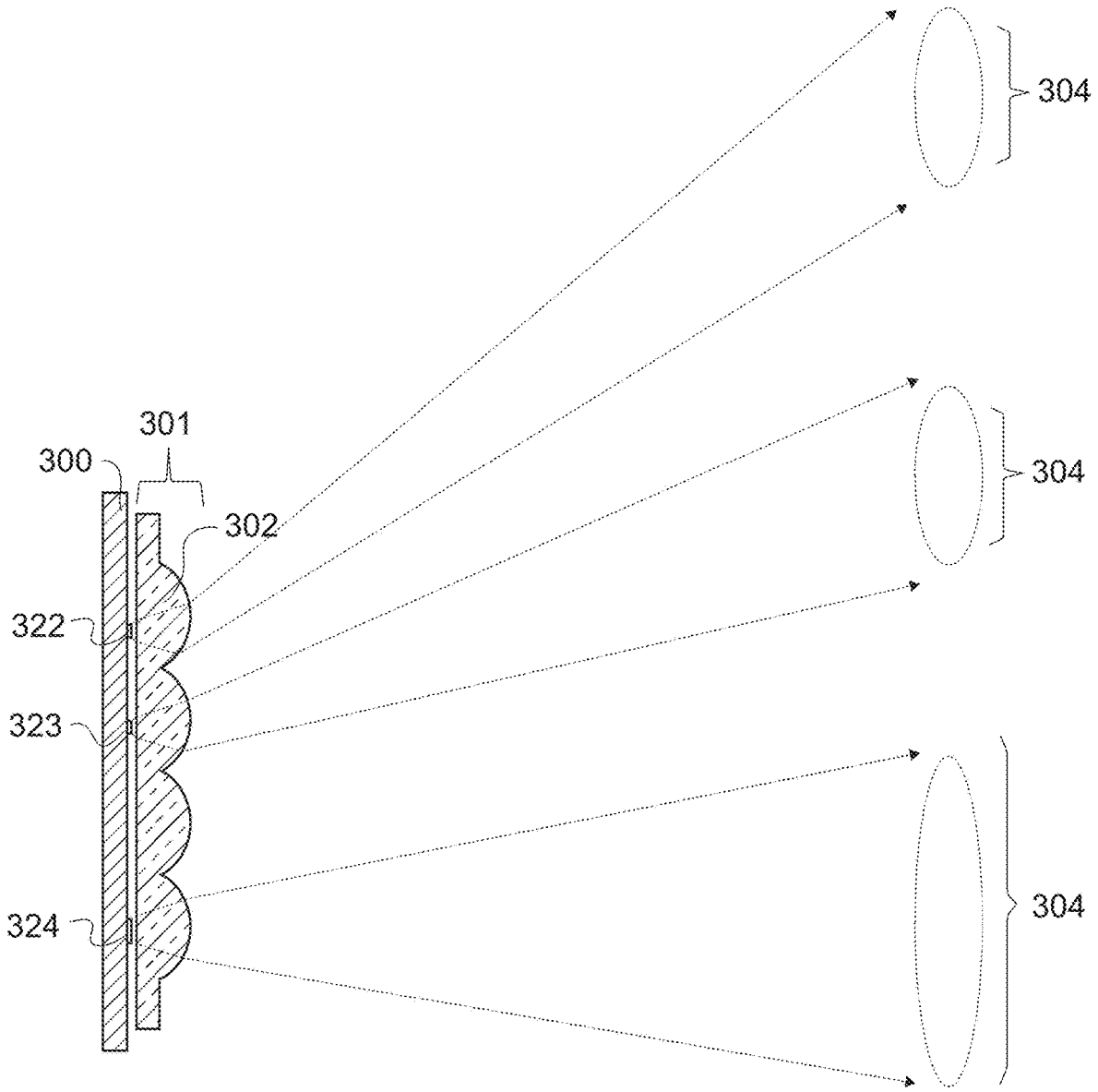
FIG. 36 provides an example of varying LED type to create beamlets of different color temperature and size.

Further, light sources 303 of varying size, brightness, color, or design may be incorporated on the common circuit board 300 and with a common lens array 301 to produce complex light output patterns and to provide variability in color. FIG. 36 shows an example in which a circuit board 300 is populated with light emitters 322 and 323 that emit light of different colors (or white light of different color temperatures), producing beamlets 304 of different colors. In this example, light emitter 324 is larger than 322 and 323, and therefore produces a wider beamlet 304 than the other emitters when paired with identical lenses 302.

Further, non-uniform lens arrays 321 may be combined with non-uniform selection of light emitters 303 to provide even greater flexibility in lightfield design.

Figure 37:
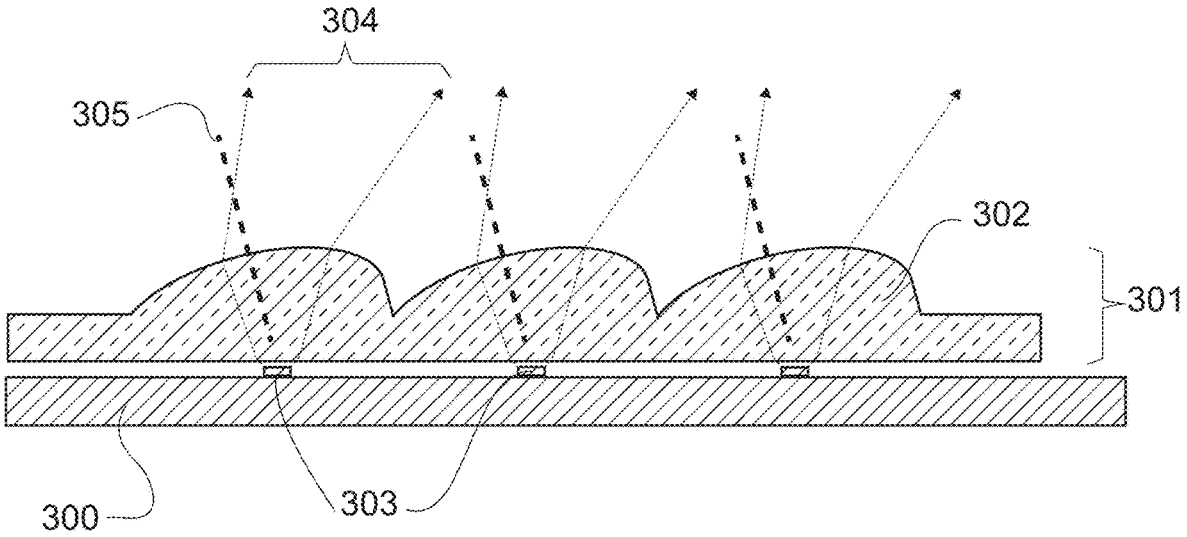
FIG. 37 provides an example of tilting the optical axis of lenses to bias light emission toward a specific direction.

FIG. 37 shows that the direction of the optical axis 305 of lenses 302 can be tilted to directions that are not normal to the plane of the array of lenses 301 in order to tilt light emission. This allows for light output patterns from a direct lightfield luminaire to be biased toward one direction; for example, where a luminaire may be used primarily to illuminate a wall without physically tilting the luminaire itself.

Figure 38:
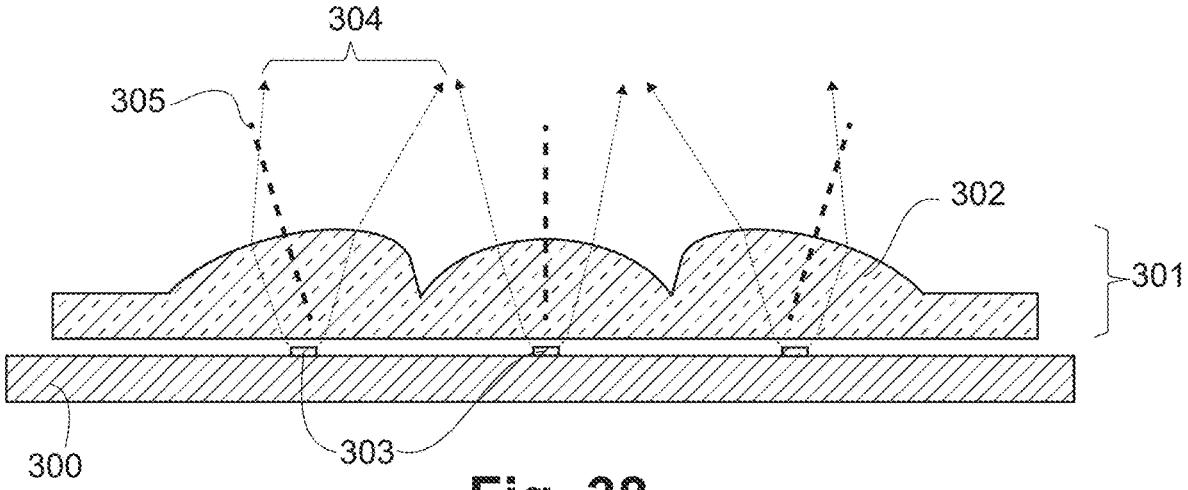
FIG. 38 provides an example of varying the orientation of the optical axis of lenses within the array of lenses to provide an expanded range of addressable beamlet directions.

FIG. 38 shows that the direction of the optical axis 305 of lenses 302 can also vary in different directions within a luminaire. For a given optical formula for lenses 302, there is a limited range of light steering angles that can be achieved before the resulting lightfield is significantly distorted or dimmed, as shown in FIG. 19. Providing for many directions of the optical axis 305 within a luminaire expands the range of light steering angles that can be addressed within the luminaire.

In another variation, the plano-convex singlet lenses shown in the various Figs. herein may be replaced with more complex lenses, for example doublets such as those described above.

Multiple Circuits

Figure 39:
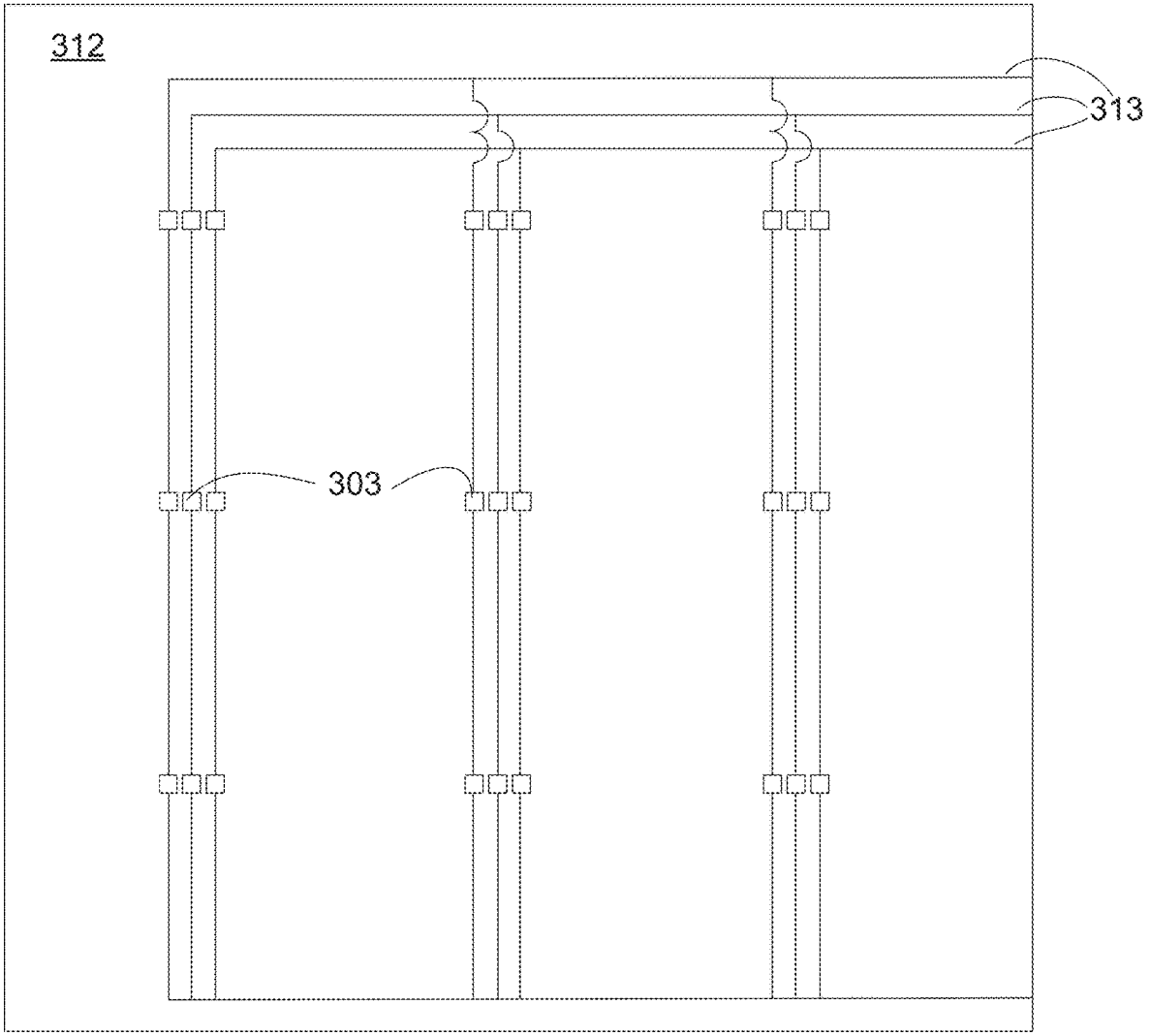
FIG. 39 provides a schematic example of a circuit board with multiple independent circuits of light sources.

FIG. 39 shows how circuit board 300 may be implemented as an example multiple circuits board 312 containing three independently-controlled circuits, wherein different positions 307 are connected to different circuits 313. Such a multiple circuits board 312 may be populated with light sources 303 in such a way that multiple different lighting scenes can be created by activating the different circuits 313.

Figure 40:
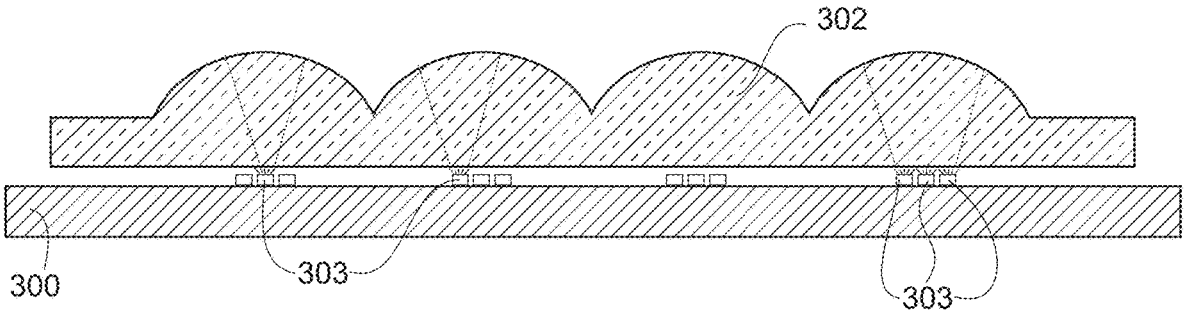
FIG. 40 provides a cross-section view of a lightfield luminaire using the circuit board of FIG. 39. This example features 3 light emitters within each lens, with the 3 corresponding circuits to activate the light emitters. Activating only one of the three circuits will result in narrow beams, either centered or steered in one of two directions depending on which circuit is activated. Activating all three circuits will result in a wide centered beam.

FIG. 40 shows a cross-section view of the multiple circuits board of FIG. 39, along with a lens array 301. In this example, each lens element 302 is associated with three light emitters 303, one connected to each circuit. Powering one of the circuits activates light emitters 303 aligned with the center optical axis of each lens element 302, therefore producing a narrow centered beam of illumination. Powering a different circuit activates light emitters 303 all identically offset from the center optical axis of each lens element 302, resulting in a narrow offset beam of illumination. Powering all three circuits activates all light emitters, resulting in a broad, centered beam. This design therefore provides for independent control of lighting in different directions or adjusting beam size from narrow to broad.

Reflective System

Figure 41:
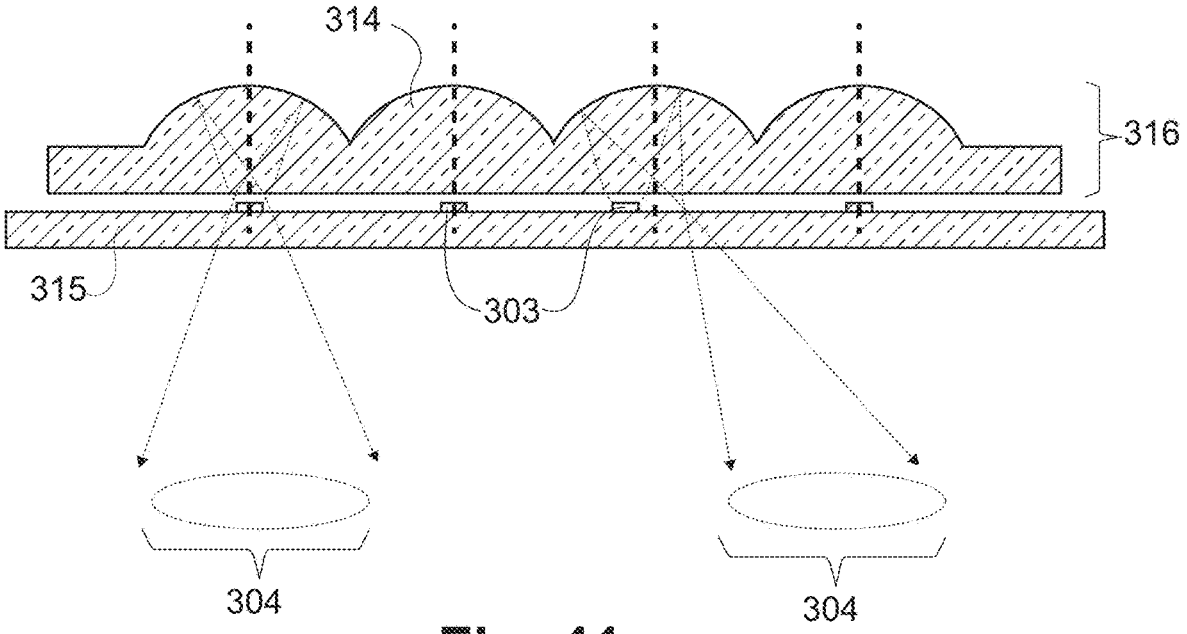
FIG. 41 provides an example of a direct lightfield luminaire utilizing an array of reflectors and a perforated circuit board.

FIG. 41 shows a direct lightfield luminaire that utilizes reflectors 314 to collimate rather than refractive lenses. A transparent or perforated circuit board 315 is approximately at the focal plane of an array of reflectors 316 comprised of reflectors 314. The perforated circuit board 315 is populated with light emitting diodes or other light sources 303. The direction of the beamlet 304 from a particular light source 303 depends upon its position within the focal plane of its associated reflector 314. The total output light pattern of the luminaire is the aggregate of all the steered beamlets 304 produced by each light source 303 as they are reflected by the array of reflectors 316. A desired total light output pattern may be constructed by choosing where light sources 303 are located on perforated printed circuit board 315. Many of the same variations and improvements described for direct lightfield luminaires that utilize refractive lenses can also be applied to lightfield luminaires that utilize reflectors.

Adjustment

The lightfield luminaire embodiments described above may be implemented with circuit board and lens (or reflector) array elements permanently fixed together. Alternatively, the designs may be implemented with a mechanism that allows the circuit board and the lens (or reflector) array to vary in position relative to one another, via displacement that is at least largely parallel to the plane of the circuit board. Such motion will adjust the direction in which the lightfield beam pattern is projected, providing a useful capability for luminaire installation.

These examples are not exhaustive, and other useful implementations of the direct lightfield luminaire will, after reading the above text and referring to the accompanying drawings, be evident to those skilled in the art.

A mixing channel can improve the uniformity of color and intensity of a light emitting source, such as a light emitting diode. The mixing channel may have an interior surface of high reflectivity, and fits around the diameter or diagonal of the source.

The mixing channel may be of sufficiently short length to interact with less than 50% of the emitted light from the source.

The mixing channel may be hollow, or filled with a transparent material. If filled with a transparent material, that material may have a smooth face at the exit aperture of the channel, or a textured face.

The interior surface may be specular or scattering.

The mixing channel may flare from a smaller dimension around the light emitting source to a wider dimension at the optical exit aperture. Such a flare may optionally provide the cross-sectional shape of a compound parabolic concentrator.

The mixing channel may be formed as a hole in a slab of material; as a component attached to a circuit board with adhesive, solder, or mechanical retention elements; or as a feature of the emitter submount.

This filing also describes a luminaire consisting of a circuit board populated by light emitters in certain locations and an optical layer that contains one or more arrays of lenses. The locations of the light emitters can be adjusted during the design or population of the circuit board in order to customize the lighting distribution produced by the luminaire.

The circuit board may optionally contain a dense array of such locations, so that any subset may be populated as desired.

The circuit board may optionally contain more than one circuit, so that different lighting distributions can be produced by the luminaire by activating different circuits.

The lens array may be uniform, or may contain lenses of varying size, power, or orientation. The light emitters may be uniform, or may vary in size, power, or color.

The lens array may contain one or more layers of refractive lens elements, or may contain reflective lenses.

The luminaire may further contain a mechanism for adjusting the relative positions of the lens array and the circuit board via displacement that is largely parallel to the plane of the circuit board.

It will be apparent that the position and/or lighting control systems and/or methods, described herein, may further include different forms of mechanisms, electronics hardware, firmware, or a combination of hardware and software. The actual specialized control systems and/or methods used to implement these systems and/or methods is, therefore, not limiting of the implementations.

Even though particular combinations of features are recited in the claims and/or disclosed in this specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set. Therefore, no element, act, or instruction used herein should be construed as critical or essential unless explicitly claimed as such.

What is claimed is:

1. An adjustable luminaire comprising:

a light-emitting source having a light-emitting major surface and an optical center, a first lens having a first optical axis, a second lens having a second optical axis, the two lenses disposed with their respective optical axes being parallel, the first lens disposed adjacent the light-emitting major surface, and the second lens disposed adjacent the first lens, such that light passes from the light-emitting major surface, to the first lens and then to the second lens, and a mechanism in contact with at least the light-emitting source, or at least a selected one of the lenses, that provides adjustment of a position of the respective optical axis of the selected of the lenses with respect to a position of the light emitting source in a direction orthogonal to the optical axis of the selected one of the lenses, to thereby control a direction of a resulting light beam emitted from the luminaire.

2. The adjustable luminaire of claim 1, wherein:

the first optical axis of the first lens and the second optical axis of the second lens are fixed in position relative to each other, and the mechanism provides for the adjustment of the position of the optical axis of the first lens and the optical axis of the second lens together, relative to the optical center of the light-emitting source.

3. The adjustable luminaire of claim 1, wherein:

the mechanism provides for the adjustment of the position of the first optical axis and of the second optical axis relative to the optical center in a common direction of adjustment but at different rates of adjustment.

4. The adjustable luminaire of claim 1, wherein the first lens is of greater optical power than the second lens.

5. The adjustable luminaire of claim 1, wherein at least one of the lenses has at least one textured surface.

6. The adjustable luminaire of claim 1, wherein at least one of the lenses has one of a concave surface, a convex surface, or a planar surface.

7. The adjustable luminaire of claim 1, additionally comprising:

a beam conditioner disposed adjacent the light source.

8. The adjustable luminaire of claim 7, wherein the beam conditioner is one of a lens, a collimating reflector, or a light mixing channel.

9. The adjustable luminaire of claim 7, wherein the beam conditioner provides for the reduction of the light beam emitted by the light source to an angular width of less than 120 degrees.

10. The adjustable luminaire of claim 1, wherein the light-emitting source comprises a light-emitting diode.

11. The adjustable luminaire of claim 10, wherein the light-emitting source comprises a plurality of light-emitting diodes.

12. The adjustable luminaire of claim 11, wherein the light-emitting source comprises a plurality of light-emitting diodes and a contiguous phosphor-bearing layer disposed over the light-emitting diodes.

13. The adjustable luminaire of claim 11, where the mechanism also provides for adjustment of a distance between the selected one of the lenses and the light source in a direction parallel to the optical axis of the selected one of the lenses.

14. The adjustable luminaire of claim 1, where the mechanism comprises a barrel to retain one or more of the first and second lenses.

15. The adjustable luminaire of claim 1, where the mechanism comprises one or more magnets and one or more portions of ferromagnetic material and provides for adjusting the position of the one or more magnets over the one or more portions of ferromagnetic material.

16. The adjustable luminaire of claim 1, wherein light from the light-emitting source enters the first lens primarily in an area that is smaller than the full entry face of the first lens, and where the location of this area depends upon a position of the first lens relative to the light-emitting source.

* * * * *